US009912060B2

(12) United States Patent
Mitchell et al.

(10) Patent No.: US 9,912,060 B2
(45) Date of Patent: Mar. 6, 2018

(54) LOW-PROFILE, TAPERED-CAVITY BROADBAND ANTENNAS

(71) Applicant: U.S. Army Research Laboratory ATTN: RDRL-LOC-I, Washington, DC (US)

(72) Inventors: Gregory A. Mitchell, Olney, MD (US); Wasyl Wasylkiwskyj, Bethesda, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 394 days.

(21) Appl. No.: 14/593,292

(22) Filed: Jan. 9, 2015

(65) Prior Publication Data

US 2016/0204510 A1 Jul. 14, 2016

(51) Int. Cl.

| | |
|---|---|
| ***H01Q 9/04*** | (2006.01) |
| ***H01Q 13/02*** | (2006.01) |
| ***H01Q 19/06*** | (2006.01) |
| ***H01Q 19/10*** | (2006.01) |

(52) U.S. Cl.

CPC ..... *H01Q 9/0407* (2013.01); *H01Q 13/02* (2013.01); *H01Q 19/06* (2013.01); *H01Q 19/10* (2013.01)

(58) Field of Classification Search

CPC ..... H01Q 9/0407; H01Q 13/02; H01Q 19/06; H01Q 19/10; H01Q 13/18; H01Q 1/38; H01Q 1/28; H01Q 1/286; H01Q 13/06

See application file for complete search history.

(56) References Cited

U.S. PATENT DOCUMENTS

| | | | | |
|---|---|---|---|---|
| 3,177,491 A * | 4/1965 | Rateau | H01Q 13/18 | 343/786 |
| 5,977,914 A * | 11/1999 | Harano | H01Q 3/16 | 343/700 MS |
| 6,023,244 A * | 2/2000 | Snygg | H01Q 1/246 | 343/700 MS |

(Continued)

OTHER PUBLICATIONS

U.S. Appl. No. 14/593,380, filed Jan. 9, 2015.

(Continued)

*Primary Examiner* — Dameon E Levi
*Assistant Examiner* — Jennifer F Hu
(74) *Attorney, Agent, or Firm* — Eric Brett Compton

(57) ABSTRACT

Embodiments of present inventions relate to low-profile, tapered cavity broadband antennas. One important aspect of the invention (although not the only) is the incorporation of a tapered lateral sidewalls in the antenna cavity. More particularly, according to various embodiments, a low-profile, tapered cavity antenna may comprise: an aperture defining an opening to a cavity; and an interior space defined by the cavity which is formed of a flat bottom wall defining a ground plane, and a pair of spaced-apart, tapered lateral sidewalls extending away from the flat bottom wall in opposite directions toward the aperture. The tapered shape of the tapered lateral sidewalls are specifically configured to maintain a constant resonance frequency within the cavity. In some embodiments, an isotropic high index medium material is at least partially loaded within the tapered cavity. Also, antenna may include a single or two-input port.

20 Claims, 15 Drawing Sheets

(56) References Cited

U.S. PATENT DOCUMENTS

| | | | | |
|---|---|---|---|---|
| 6,075,485 | A * | 6/2000 | Lilly | H01Q 1/38 343/700 MS |
| 6,281,858 | B1 * | 8/2001 | Jennetti | H01Q 1/007 343/795 |
| 7,408,523 | B2 * | 8/2008 | Kong | H01Q 1/42 343/700 MS |
| 7,595,765 | B1 * | 9/2009 | Hirsch | H01Q 1/28 343/789 |
| 9,448,305 | B2 * | 9/2016 | Bowers | G01S 13/887 |
| 2002/0180654 | A1 * | 12/2002 | Acher | H01Q 9/04 343/767 |
| 2003/0020655 | A1 * | 1/2003 | McKinzie, III | H01Q 1/38 343/700 MS |
| 2005/0099338 | A1 * | 5/2005 | Noro | H01Q 1/52 343/700 MS |
| 2005/0151695 | A1 * | 7/2005 | Chen | H01P 5/02 343/786 |
| 2005/0231436 | A1 * | 10/2005 | McLean | H01Q 13/0275 343/786 |
| 2006/0066467 | A1 * | 3/2006 | Kurihara | H01Q 17/008 342/1 |
| 2014/0043199 | A1 * | 2/2014 | Grange | H01Q 9/0428 343/843 |
| 2015/0207213 | A1 * | 7/2015 | Forslund | H01Q 1/3291 343/713 |

OTHER PUBLICATIONS

Gregory Mitchell & Wasyl Wasylkiwskyj, in a conference presentation at the URSI National Radio Science meeting in Boulder, CO on Jan. 9, 2014 (abstract titled "Low Profile Wide Band VHF/UHF Antenna" and slide presentation titled "Utilizing Metamaterials in the Design of a Low Profile UHF Antenna").

Gregory A. Mitchell, "Comparison of Anisotropic versus Isotropic Metamaterials in Low Profile UHF Antenna Design", ARL-TR-7012, report published by the U.S. Army Research Laboratory, Aug. 2014.

Wei Yan, Aixin Chen; Jiang, Tiehuq. Design of UHF Miniature Discone Antenna. Proceedings of 9th International Symposium on Antennas Propagation and EM Theory (ISAPE), 2010.

Aixin, Chen; Jiang, Tiehua; Chen, Zhizhang; Su, Donglin; Wei, Wenxuan; Zhang, Yanjun. A Wideband VHF/UHF Discone-Based Antenna. IEEE Antennas and Wireless Propagation Letters 2011, 10.

Chen, A.; Jiang, T.; Chen, Z.; Su, D. A Novel Low-Profile Wideband UHF Antenna. Progress in Electromagnetrics Research (PIER) 2011, 121, 75-88.

Lagarkov, A. N.; Semeneko, V. N.; Kisel, V. N.; Christyaev, V. A. Development and Simulation of Microwave Artifical Magnetic Composities Utilizing Non-magnetic Inclusion. Journal of Magnetism and Magnetic Materials 2003.

Maslovski, S.; Ikonen, P.; Kolmakov, I.; Tretyakov S. Artificial Magnetic Materials Based on the New Magnetic Particle Metasolenoid. Progress in Electromagnetics Research (PIER) 2005, 54, p. 61-81.

Baily, M. C. Broadband Half Wave Dipole. IEEE Trans. on Antennas and Propagation Apr. 1984, AP-32 (4).

Schelkunoff, S. A. Schelkunoff. Electromagnetic Waves. DuHameIH 1943, 9, Van Nostrand, New York, pp. 316-322.

Williamson, A. G..Analysis and Modeling of a Coaxial-line/Rectangular-waveguide Junction. IEEE Proceedings (Microwaves, Optics, and Antennas), vol. 129, Issue 5. Oct. 1982.

Wade, P. Rectangular Waveguide to Coax Transition Design. QEX, Nov./Dec. 2006.

David Pozar. Microwave Engineering. 3rd. ed., John Wiley and Sons, 2005, pp. 106-116 and 278-279.

* cited by examiner

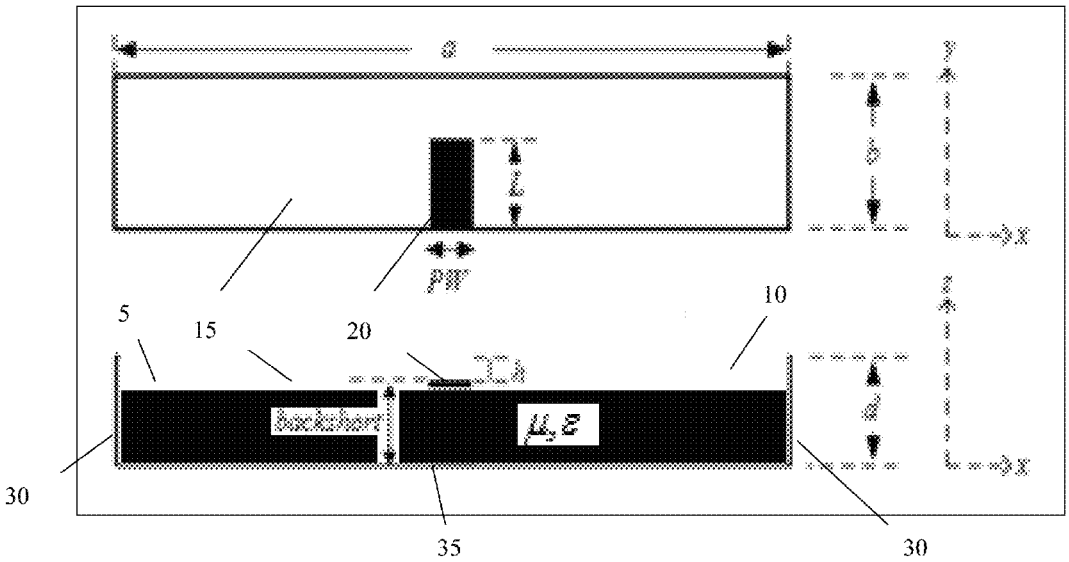
FIG. 1(a) top, and FIG. 1(b) side views
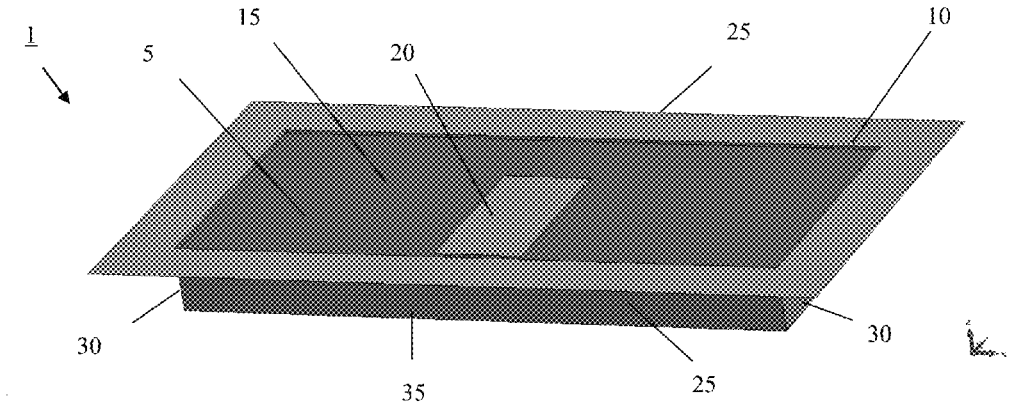
FIG. 1(c) isometric view

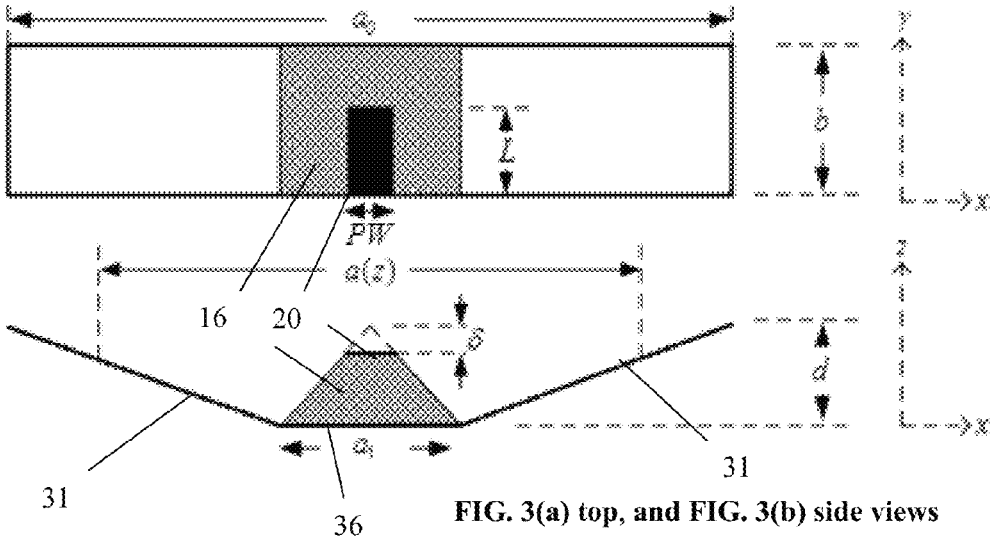
FIG. 3(a) top, and FIG. 3(b) side views
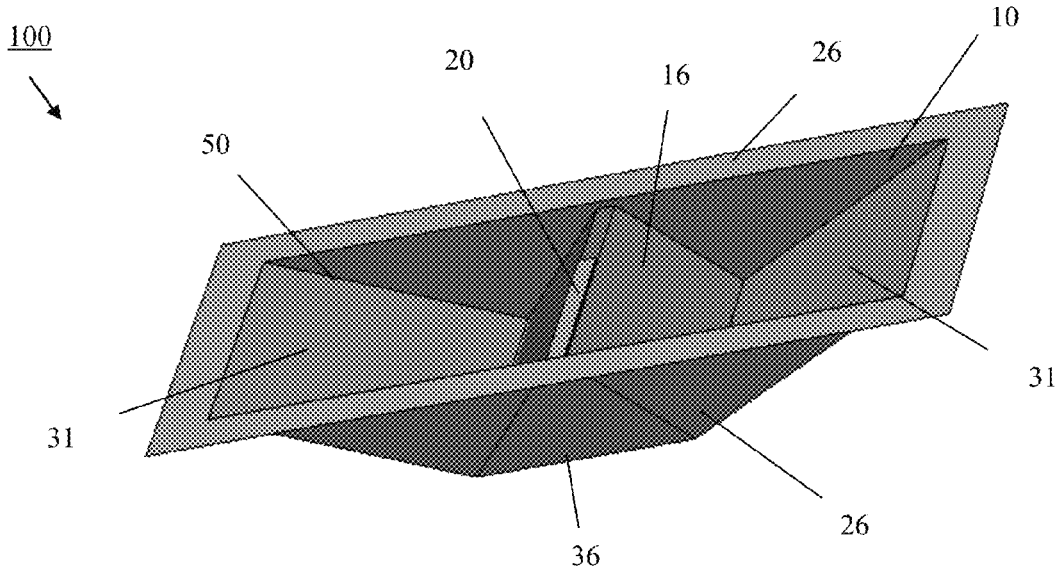
FIG. 3(c) isometric view

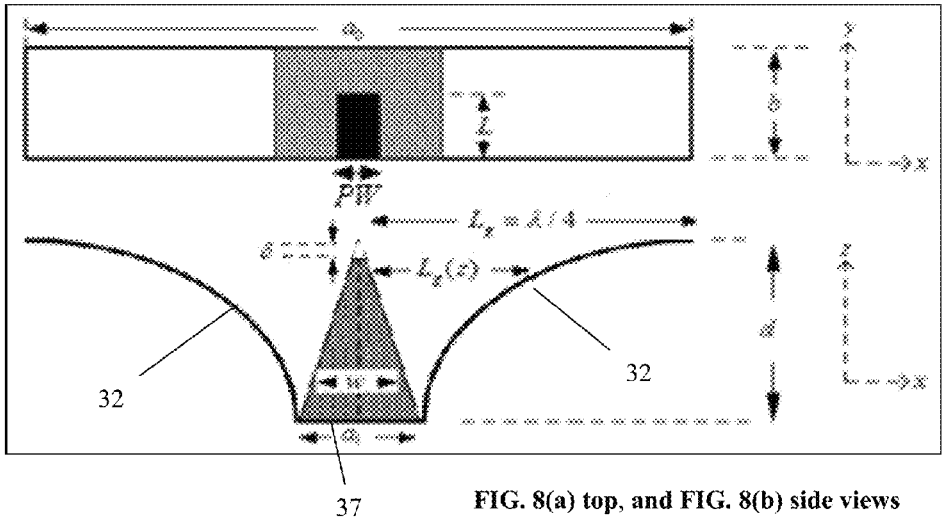
FIG. 8(a) top, and FIG. 8(b) side views
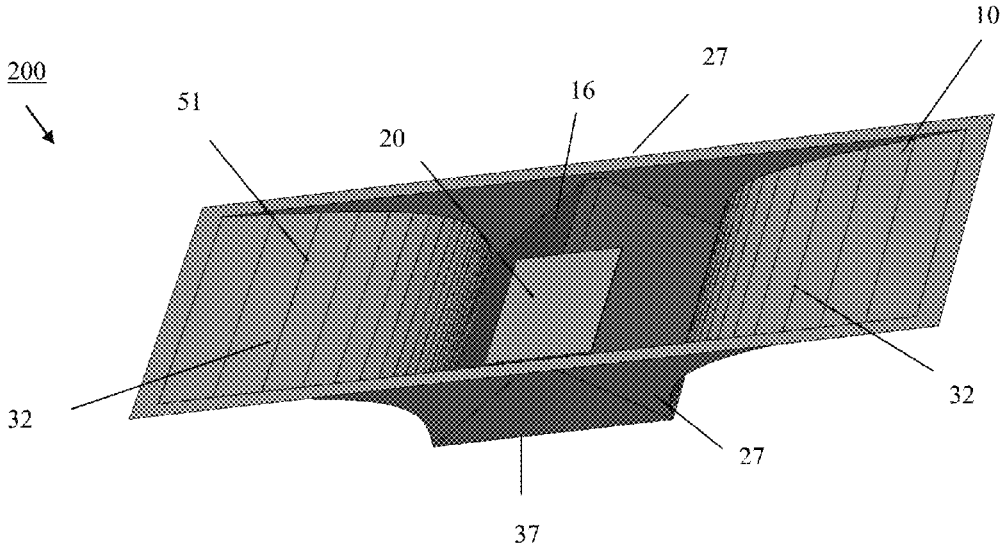
FIG. 8(c) isometric view

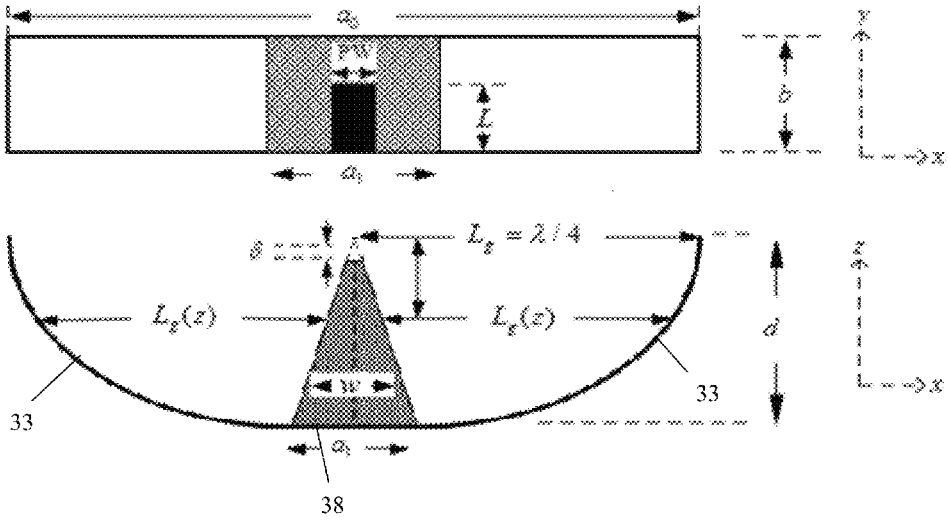
FIG. 9(a) top, and FIG. 9(b) side views
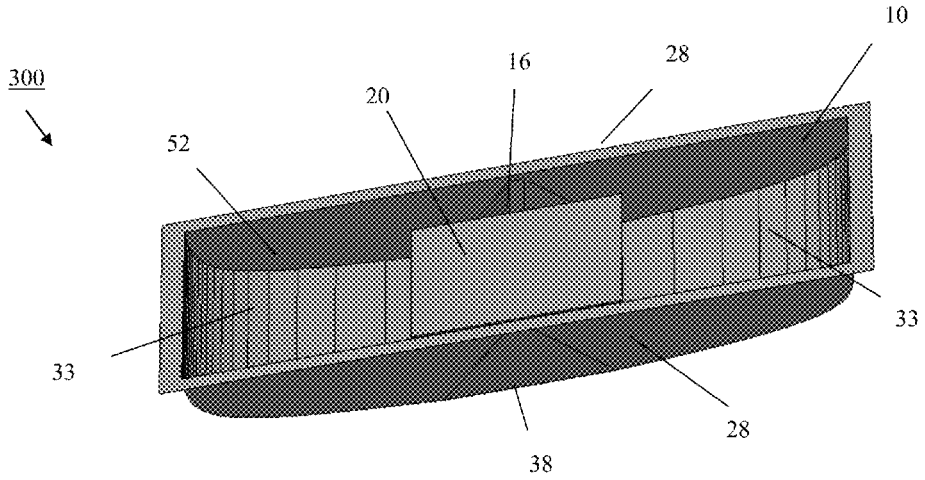
FIG. 9(c) isometric view

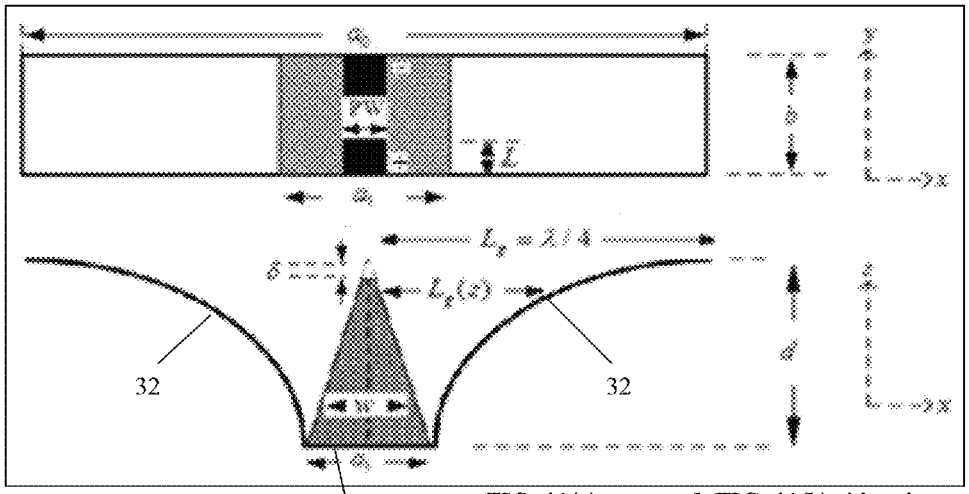
FIG. 11(a) top, and FIG. 11(b) side views
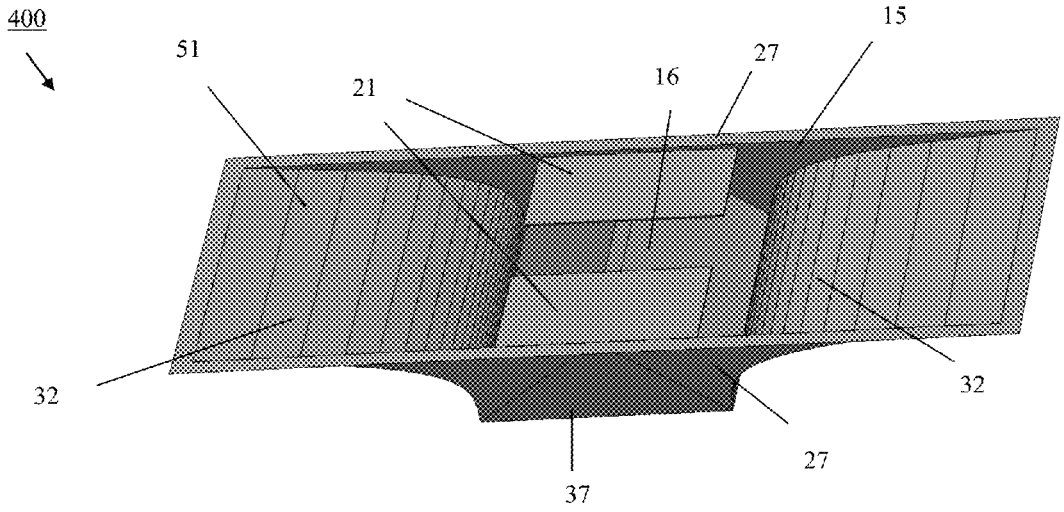
FIG. 11(c) isometric view

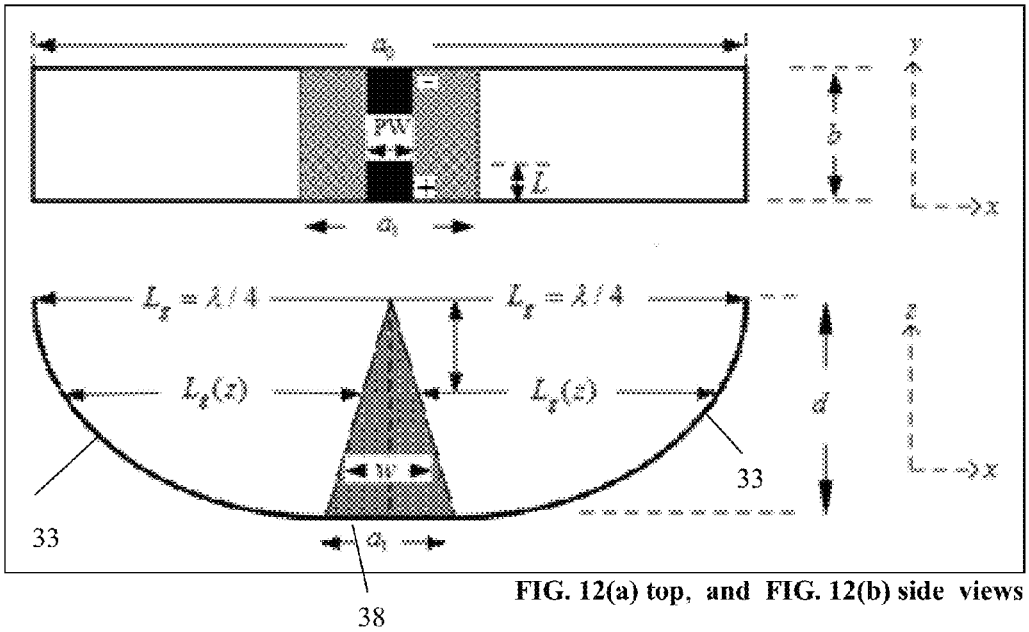
FIG. 12(a) top, and FIG. 12(b) side views
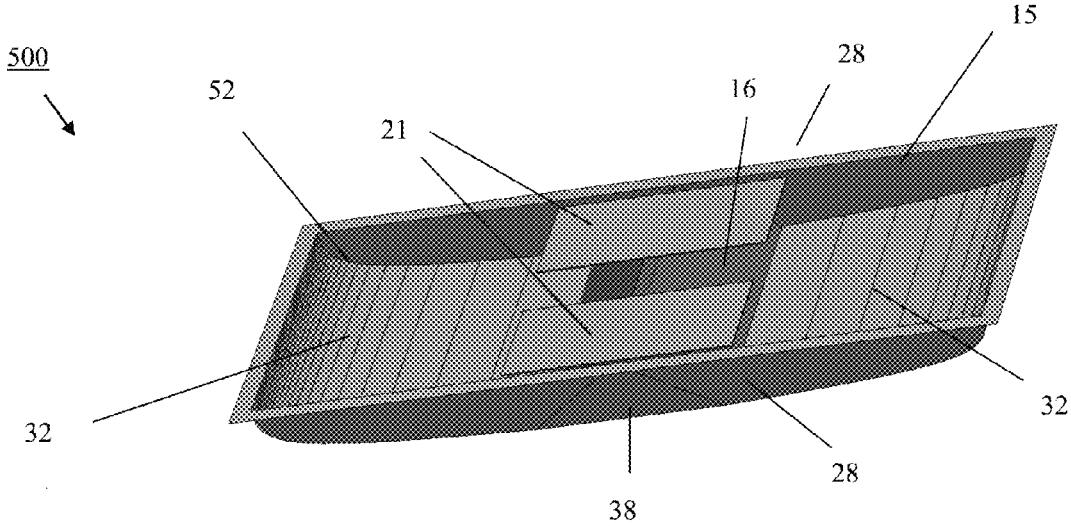
FIG. 12(c) isometric view

LOW-PROFILE, TAPERED-CAVITY BROADBAND ANTENNAS

GOVERNMENT INTEREST

Governmental Interest—The invention described herein may be manufactured, used and licensed by or for the U.S. Government.

RELATED APPLICATION(S)

This patent application is related to U.S. patent application Ser. No. 14/593,380 filed on Jan. 9, 2015, titled "LOW-PROFILE CAVITY BROADBAND ANTENNAS HAVING AN ANISOTROPIC TRANSVERSE RESONANCE CONDITION", herein incorporated by reference in its entirety.

BACKGROUND OF THE INVENTION

I. Field of the Invention

Embodiments of the present invention generally relate to antenna technology, and more particularly to, low-profile, tapered cavity broadband antennas.

II. Description of the Related Art

High index dielectric ceramics have been used to create low profile antennas at low UHF bands, for instance. However, these are generally bandwidth limited due to the fact that it is very difficult to match a high dielectric material over more than a narrow band. This stems from the fact that impedance is calculated as $Z_o=(\mu/\in)\hat{}0.5$ which becomes very small as $\in$ increases.

Techniques using double negative (DNG) metamaterials which mimic a perfect magnetic conductor (PMC) ground plane using a principle known as electro-band gap (EBG) have been considered. Using antenna image theory, a PMC ground plane allows an antenna to approach the ground plane without cancelling out its radiation pattern, however, PMC ground planes do not exist naturally. DNG materials yield a negative $\mu$ and $\in$, but again are very bandwidth limited. This is because currently metamaterials only exhibit these negative properties at a narrowband resonance. Therefore, theoretically a nearly infinitely thin antenna could be created using this technique, but not with wide bandwidth operational characteristics.

Thus, improvements to low-profile antennas would be useful.

BRIEF SUMMARY OF THE INVENTION

Embodiments of present inventions relate to low-profile, tapered cavity broadband antennas. One important aspect of the invention (although not the only) is the incorporation of a tapered lateral sidewalls in the antenna cavity. The cavity may have an overall rectangular shape.

More particularly, according to various embodiments, a low-profile, tapered cavity antenna may comprise: an aperture defining an opening to a cavity; and an interior space defined by the cavity which is formed of a flat bottom wall defining a ground plane, and a pair of spaced-apart, tapered lateral sidewalls extending away from the flat bottom wall in opposite directions toward the aperture. The tapered shape of the tapered lateral sidewalls are specifically configured to maintain a constant resonance frequency within the cavity.

The antenna embodiments are designed to provide broadband response in operation. For some applications, ultra high frequency (UHF) spectrum, from about 300 MHz to about 3 GHz, may be of importance (although, it will be appreciated that the inventions is not limited to such). At lower frequencies (e.g., below about 1.0 GHz), in some embodiments, an isotropic high index medium material is at least partially loaded within the tapered cavity. Alternatively, one could achieve a low profile, antenna with an air-filled tapered cavity alone in some embodiments. This configuration may be possible for high frequencies (e.g., above about 1.0-1.5 GHz).

Both magnetic and dielectric isotropic high index medium material may be used, for example. More particularly, the isotropic high index medium material may be a dielectric dominant material having a permittivity $\in_r$ greater than its permeability $\mu_r$. Or the isotropic high index medium material may be a magnetic dominant material having a permittivity $\in_r$ less than its permeability $\mu_r$. When used, the isotropic high index medium material may be provided on the flat bottom wall of the antenna cavity. In some embodiments, the isotropic high index medium material can be formed in the shape of a triangular prism. Although, other shapes are also possible.

The antenna cavity may further include a pair of spaced-apart, longitudinal side portions extending from opposing sides of the flat bottom wall opposite from where the tapered lateral sidewalls extend in substantially perpendicularly direction to the aperture. Also, the cavity may further include a flange surrounding the aperture.

The tapered shape of the tapered lateral sidewalls can be defined by a tangential equation, such as Equation 6 defined herein. The taper may be a linear, convex, or concave taper.

Depending on operation, the antenna may be feed with a just single input port. Or, in other embodiments, the antenna may be feed with two input port. By symmetrically feeding the two input port, more advantageous performance may be achieved in certain circumstances.

For some applications, embodiments of the antenna may be configured to provide at least 2 octaves of −6 dB bandwidth with a positive realized gain from about 150-515 MHz, for instance.

According to one particular embodiment, a low profile, tapered cavity antenna may comprise: a rectangular aperture defining an opening to a cavity; and an interior space defined by the cavity which is formed of: a flat bottom wall defining a ground plane, a pair of spaced-apart, longitudinal sidewalls extending from opposing sides of the flat bottom wall substantially perpendicular to the aperture, and a pair of spaced-apart, tapered lateral sidewalls being symmetric and extending toward the aperture from opposing sides of the flat bottom wall on opposite from where the longitudinal sidewalls extend. The antenna is configured to maintain a constant resonance frequency within the cavity.

These and other embodiments are described in more detail below.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments. These embodiments are intended to be included within the following description and protected by the accompanying claims.

FIG. 1 shows an antenna having a rectangular radiating cavity partially loaded with a high index medium material, where FIG. 1(*a*) shows a top plan view, FIG. 1(*b*) shows a side view, FIG. 1(*c*) shows an isometric view of the antenna.

FIG. 3 shows an antenna having a linear tapered cavity partially loaded with an isotropic high index medium material, where FIG. 3(*a*) shows a top plan view, FIG. 3(*b*) shows a side view, FIG. 3(*c*) shows an isometric view of the antenna.

FIG. 8 shows an antenna having a convex tapered cavity partially loaded with an isotropic high index medium, where FIG. 8(*a*) shows a top plan view, FIG. 8(*b*) shows a side view, FIG. 8(*c*) shows an isometric view of the antenna.

FIG. 9 shows an antenna having a concave tapered cavity partially loaded with an isotropic high index medium material, where FIG. 9(*a*) shows a top plan view, FIG. 9(*b*) shows a side view, FIG. 9(*c*) shows an isometric view of the antenna.

FIG. 11 shows an antenna having a convex tapered antenna cavity partially loaded with an isotropic high index medium material and having a dual symmetric rectangular probe port, where FIG. 11(*a*) shows a top plan view, FIG. 11(*b*) shows a side view, FIG. 11(*c*) shows an isometric view of the antenna.

FIG. 12 shows an antenna having a concave tapered antenna cavity partially loaded with an isotropic high index medium material and having a dual symmetric rectangular probe port, where FIG. 12(*a*) shows a top plan view, FIG. 12(*b*) shows a side view, FIG. 12(*c*) shows an isometric view of the antenna.

FIG. 14(*b*) shows the advantage of an symmetric over an asymmetric feed.

DETAILED DESCRIPTION OF THE INVENTION

Figure 2A:
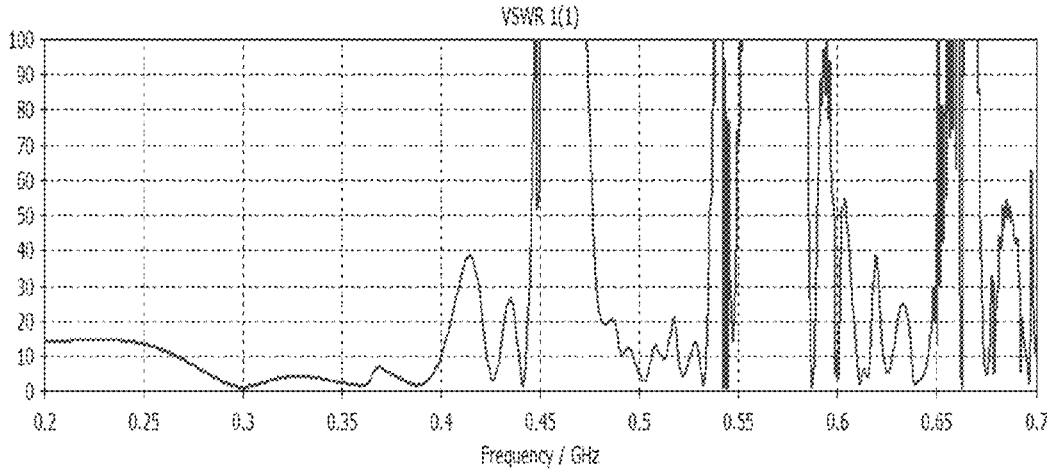
FIG. 2 shows simulated performance of the antenna shown in FIG. 1, where FIG. 2(*a*) and FIG. 2(*b*) show the voltage standing-wave-ratio (VSWR) and realized gain for the antenna, respectively.

The present invention provides low-profile, tapered cavity broadband antennas. As mentioned above, one important aspect of the invention is the incorporation of spaced-apart tapered lateral sidewalls in the antenna cavity. This advantageous feature enables the antenna to maintain a constant resonance frequency within the cavity. The cavity may have an overall rectangular shape.

Some embodiments have been successfully shown to suppress destructive interference of high order modes using the tapered geometry of the antenna cavity itself. At high frequencies (e.g., above 1.0-1.5 GHz), a designer could more easily create a low profile λ/4 cavity backed antenna without the need for high index medium material. For example $\lambda_o/4$=1.5 inches at 2 GHz. Therefore, one could achieve a thin antenna with an air-filled cavity alone.

Although, for many other embodiments, an isotropic high index medium material may be further provided, that is at least partially loaded within the tapered cavity of the antenna, which maintains an adequate electrical length between the aperture and the ground plane of the cavity while shrinking the physical length. Using high index medium material allows the reduction in cavity profile, especially for low UHF frequencies. This material can be dielectric or low loss magnetic. Both magnetic and dielectric versions of these materials have been investigated and the dielectric antenna model is based on a cheap and readily available high-index medium material. This antenna design, utilizing these materials, is believed to provide an antenna profile on the order of λ/19 at 150 MHz with a bandwidth of nearly 2.5 octaves. This allows nearly a 250% −6 dB bandwidth. The magnetic implementation of this design achieves a positive realized gain over the entire frequency band, while the dielectric antenna design achieves positive realized over 81% bandwidth. Furthermore, the antenna embodiments have been successfully shown to suppress destructive interference of high order modes using the geometry of the antenna cavity itself.

Before describing embodiments of the present invention, this disclosure first details the derivation of a low profile, tapered cavity antenna by the inventors based on an isotropic resonance condition of a partially loaded tapered cavity.

As a starting point, the inventors first began investigating an antenna having a rectangular radiating cavity. FIG. 1 shows an antenna 1 having a rectangular radiating cavity 5, where FIG. 1(*a*) shows a top plan view, FIG. 1(*b*) shows a side view, FIG. 1(*c*) shows an isometric view of the antenna.

As shown in FIG. 1, the antenna 1 includes rectangular radiating cavity 5 having a radiating aperture 10 of nominal dimensions a by b loaded with high index medium material 15. The radiating aperture 10 is the plane which defines the opening to the interior to the cavity 5. The rectangular cavity 5 is formed of a pair of spaced-apart longitudinal (long) sidewalls 25, a pair of spaced-apart lateral (short) sidewalls 30, and a flat bottom wall 35 defining an interior space. The width in the x-direction is a, the width in the y-direction is b, and the width in the z-direction is d.

The walls 25, 30, 35 of the rectangular cavity 5 have generally perpendicular (i.e., 90°) flat interfaces forming a "box-like" structure. The cavity 5 may be constructed of conducting metal and has been filled with an isotropic high index medium material 15 to reduce the size of the profile. The profile of the cavity 5 is defined as the physical distance between the aperture 10 and the bottom wall 35.

The bottom cavity wall 35 is generally considered the ground plane. It might be considered a perfect electric conductor (PEC) ground plane. In reality, though, there is no such thing as a PEC. It is only used as a theoretical construct; in actuality, the cavity would likely be metallic. Any metal material could be used to approximate the behavior of a PEC with the same results.

As apparent in FIG. 1(*b*), nearly the entire cavity 5 is filled with the high index medium material 15 with the cavity walls (25, 30, 35) surrounding the high index medium material 15. An amount of 19,723 $cm^3$ of material 15 was used for the antenna design in FIG. 1 or V=a*b*d.

The refractive index for a material is defined as $n=(\in_r*\mu_r)$ ˆ0.5 with permittivity $\in_r$ and permeability $\mu_r$. In general, a high index medium material may be considered any material with n>1 and is typical for many materials having $\in_r>1$ and/or $\mu_r>1$. To the extent possible, a material having the highest refractive index possible may be utilized.

Traditional isotropic materials, such as duroid ($\in_r=2.1$, $\mu_r=1$) or Rogers 6010 ($\in_r=10.2$, $\mu_r=1$), for example, available from the Rogers Corporation, can be used for material 15. These microwave laminates are ceramic-PTFE composites designed for electronic and microwave circuit applications requiring a high dielectric constant. As an isotropic material, its physical properties are the same (or nearly the same) in every direction. Thus, the impedance may be defined as $$Z_c = \sqrt{\mu_r/\varepsilon_r}\,.$$

Of course, various other known isotropic compositions for material 15 might also be used.

The electromagnetic field inside the cavity 5 is stimulated via a metallic rectangular probe port 20 disposed on top of the high index medium material 15 that is fed by a coaxial cable (not shown). The probe port 20 may be formed of metal of other conductor. It may be located a distance h from the aperture 10. The width (PW) and length (L) of the port 20 have been optimized to provide the best impedance match at the coaxial input (e.g., 50 S2).

This antenna design and simulations thereof were used as a starting point by the inventors. They demonstrate how loading a rectangular cavity 5 with a high index medium material 15 shifts the resonant frequency and creates instability in the impedance match. This instability is further highlighted with respect to FIGS. 2(*a*) and 2(*b*), discussed below. By contrast, as will be further explained, embodiments of the present invention provide a novel tapered cavity design which circumvents this problem by maintaining a constant resonance frequency when loading with an isotopic high index medium material.

Table 1 shows dimensions for simulations run by the inventors for evaluating the antenna geometry in FIG. 1. It is noted that all dimensions in this table are in inches except for the resonance frequency $f_r$. The back short dimension refers to the separation between the port 20 and the bottom wall 35 of the cavity 5.

TABLE 1

| back short | a | b | $f_r$ (MHz) | PW | d | L | h |
|---|---|---|---|---|---|---|---|
| $\lambda_r/4$ | $\lambda_o/2$ | a/2.25 | 200 | 4.3 | $\lambda_r/4$ + h | 8.5 | 0.12 |

The size of the aperture 10 in the x-direction here is designed to be $a=\lambda_o/2$ (i.e., half free-space wavelength) at 200 MHz, and the back short is $\lambda_r/4$ at the center frequency (350 MHz) of the frequency band of interest where:

$$\lambda_r = \frac{\lambda_o^{cf}}{\sqrt{0.5\varepsilon_r\mu_r - \left(\frac{\lambda_o^{cf}}{(2a)}\right)^2}} \tag{1}$$

$\lambda_o^{cf}$ is the free space wavelength at the center frequency, and $\lambda_r$ is wavelength inside the high index medium. The subscript r does not denote a direction; rather it is simply a subscript that is used to differentiate it from the free space wavelength ($\lambda_o$). In operational terms of the antenna, $\lambda_r$ can be considered the resonance wavelength. $\lambda_r/4$ inside the cavity will yield in-phase addition of the radiated wave and the reflected wave at the aperture. This in-phase addition will essentially double the radiated power if the feed maintains a good impedance match at the input. Equation 1 indicates that by increasing $\in_r$ and/or $\mu_r$, the value of $\lambda_r$ is reduced, which will serve to reduce the profile of the rectangular cavity since this is approximately $\lambda_r/4$ at 350 MHz.

Figure 2B:
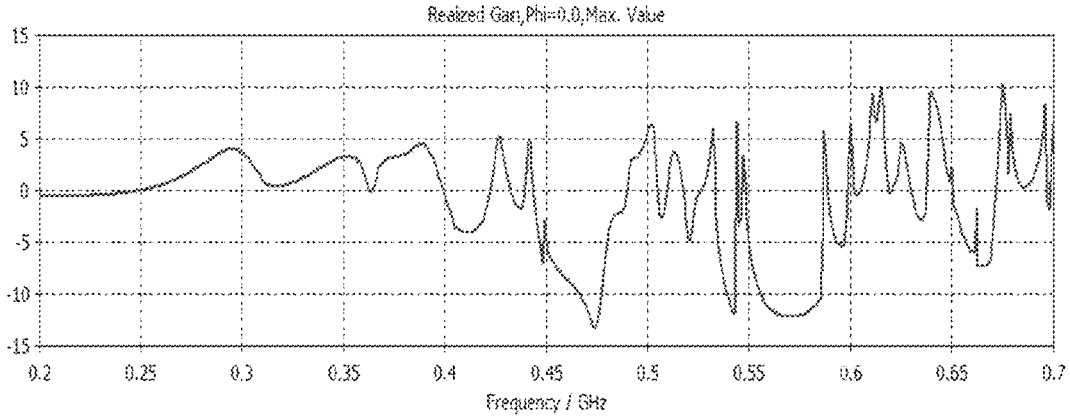

FIG. 2 shows simulated performance of the antenna shown in FIG. 1, where FIG. 2(*a*) and FIG. 2(*b*) show the voltage standing-wave-ratio (VSWR) and realized gain for the antenna, respectively.

As generally understood by one in the art, the VSWR is another way of looking at the impedance match at the input port to the antenna. A VSWR of 3:1 corresponds to −6 dB and 2:1 corresponds to −10 dB. The unstable nature of the VSWR indicates that there are several resonances operating within the rectangular cavity for these dimensions—which is expected because Equation 1 realizes that when $\mu_r$ and/or $\in_r$ of the material inside the rectangular cavity increases, the resonance frequency decreases. The resonance frequency is defined as $f_r=c_o/\lambda_r$. Here, $c_o$ is defined as the speed of light in a vacuum.

For the simulated performance, where the dielectric medium in the cavity has $\in_r=10$ and $\mu_r=1$, a=29.5"=2012 at 200 MHz, then $f_r=63.25$ MHz yielding unstable results for the VSWR and realized gain. Since additional resonances begin to operate at each octave, this means that every 63.25 MHz an additional resonance is introduced to the rectangular cavity so that at 200 MHz there are up to three resonances operating inside the rectangular cavity, and at 500 MHz there are as many as seven resonances.

The results of FIGS. 2(*a*) and 2(*b*) demonstrate that as more resonances begin to appear within the rectangular cavity, the performance of the antenna is severely degraded. Looking at the VSWR in FIG. 2(*a*) shows how poorly this antenna performs. A functional antenna is generally considered to have a VSWR of 3 or better. The antenna of FIG. 1 has a VSWR greater than 10 over much of the band making the antenna unusable. Portions of the band that have low VSWR are due to the tuning out of the reactance in the cavity by the probe, but that these portions are extremely narrowband. The increase in instability above 400 MHz is due to the fact that there are more resonances within the cavity.

Having multiple resonances will tend to interfere destructively making it very difficult to achieve a good impedance match over a wide bandwidth. The existence of multiple resonances is an unavoidable consequence of waveguide theory when introducing high index materials because they lower the resonance frequency of the cavity. The inventors believe that only the first resonance should operate over the frequency band because multiple resonances tend to interfere destructively. Therefore, they determined that $f_r$ would need to remain constant to ensure operation of only the lowest resonance at the frequency of operation.

FIG. 3 is an illustration of an antenna 100 having a linear tapered antenna cavity 50 partially loaded with high index material 16, where FIG. 3(*a*) shows a top plan view, FIG. 3(*b*) shows a side view, FIG. 3(*c*) shows an isometric view of the antenna.

The tapered cavity 50 is formed of a pair of spaced-apart longitudinal (long) sidewalls 26, a pair of spaced-apart laterally-tapered (short) sidewalls 31, and the flat bottom wall 36 defining an interior space.

The cavity 50 may have an overall rectangular shape. Here, the linear tapered cavity 50 has an overall length $a_0$ and width b with the flat bottom wall 36 having a length $a_1$ and the tapered sidewalls 31 tapering in such a way as to maintain a nearly constant $f_r$. The width b is constant. As apparent, the tapered sidewalls 31 have a linear taper extending away from the flat bottom wall 36 portion in opposite directions toward the aperture 10. The tapered sidewalls 31 are symmetrically shaped.

It is noted that that there may be a 1.0 inch metallic flange, not shown, surrounding the aperture at z=0. This flange serves dual purposes. The first is providing a mounting apparatus for any flat surface that the antenna may be embedded within. Secondly, it serves to mitigate some of the edge effects that would otherwise be seen at the aperture edges and to partially suppress some of the antenna's back radiation.

An isotropic high index medium material 16 is at least partially loaded within the tapered cavity 50. This material may be the same as material 15 that discussed above with respect to antenna 1. As will be appreciated, the isotropic high index medium material 16 is also linearly tapered using an inverse relationship to that of the width of the cavity walls. Here a(z) changes to maintain $f_r$ dependent on the width of the high index material at point z in the cavity. The rectangular probe is located at z=−δ+0.08".

In this antenna geometry, the aperture length $a_0$ serves the same purpose as a in FIG. 1, where $f_r$=200 MHz and w(z)=0 at point z=0. Dimension $a_1$ of the flat bottom portion represents the value of $\lambda_r/2$ that maintains $f_r$=200 MHz when the transverse plane of the rectangular cavity is completely filled with the high index medium and $w=\lambda_o/(2\sqrt{\in_r\mu_r})$. The shape of the rectangular cavity is determined by a straight line between the points ($a_0/2$, z=0) and ($a_1/2$, z=−d). This is only an initial approximation to the shape of the tapered rectangular cavity, but by investigating how this approximation works, a determination was made whether this type of design for the antenna was worth pursuing.

In FIG. 3, the profile height d is determined as $\lambda'_r/4$ where $$\lambda'_r = \frac{\lambda_o^{cf}}{\sqrt{0.5\varepsilon_r\mu_r - \left(\frac{\lambda_o^{cf}}{(a_0 + a_1)}\right)^2}}. \quad (2)$$

Equation 2 averages $\lambda_r$ from equation 1 over d for the changing ratio of the high index medium to air in the cavity. The quantity δ is the distance between the top of the high index medium material 16 and the antenna aperture 10. Ideally, the material 16 would end in a tip with infinitesimal width, but this type of structure cannot be resolved in a numerical model. This explains why in FIG. 3 and other figures, the top of the high-index medium material 16 appears slightly truncated (or chopped off).

Table 2 gives the dimensions corresponding to FIG. 3 for the antenna models analyzed in this section. It is noted that all dimensions in this table are in inches except for the resonance frequency $f_r$. The $f_r$ has been reduced to 192.5 MHz because the behavior in a rectangular cavity can be unpredictable directly at $f_r$. In practice, it may be best to lower $f_r$ to a value below the desired frequency of operation.

A metallic rectangular probe port 20 disposed on top of the high index medium material 16 having dimensions PW by L. PW has been reduced to be the same width as the top of the material 16. This was initially thought to provide the smoothest impedance transition from the high index medium material 16 to free space.

TABLE 2

| $a_0$ | b | $a_1$ | $f_r$ | d | δ | PW | L |
|---|---|---|---|---|---|---|---|
| $\lambda_o/2$ | $a_0/2.25$ | $a_0/(\in_r\mu_r)^{\wedge}0.5$ | 192.5 MHz | 4.2 | 0.27 | 0.7 | 8.5 |

Figure 4A:
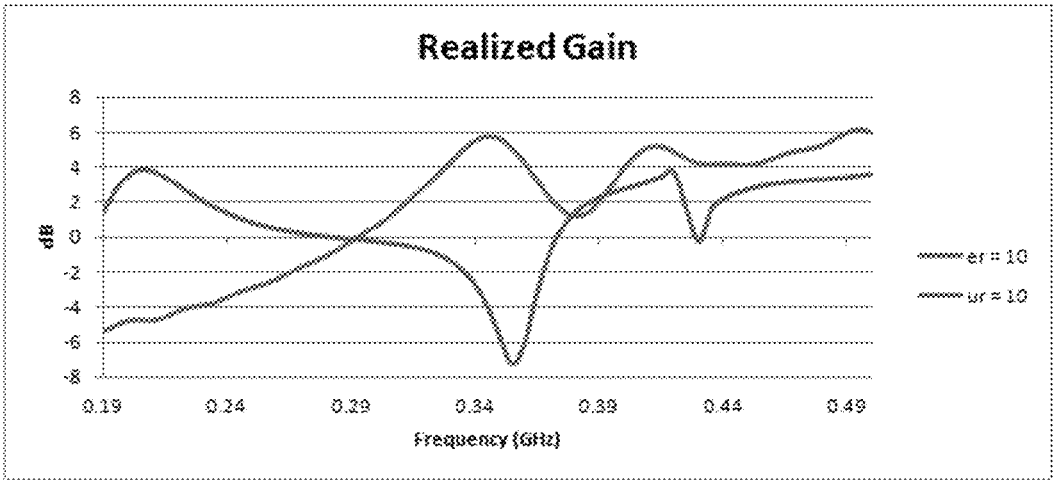
FIG. 4 depicts simulation results for the antenna model in FIG. 3 loaded with dielectric and magnetic isotropic material, where FIGS. 4(*a*) and 4(*b*) show plots of (a) realized gain, and (b) return loss (|S11|), respectively.
Figure 4B:
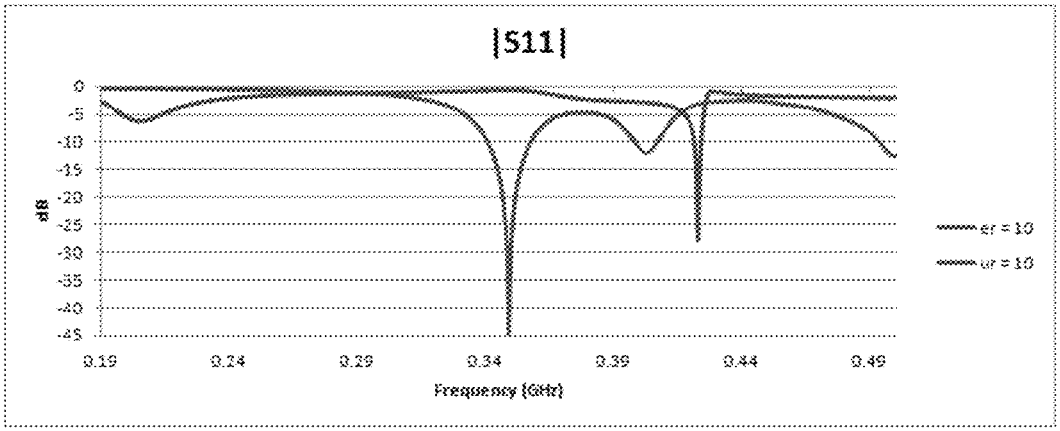

FIG. 4 depicts simulation results for the antenna model in FIG. 3 loaded with dielectric and magnetic isotropic material for material 16, where FIGS. 4(*a*) and 4(*b*) show plots of (a) realized gain, and (b) return loss (|S11|), respectively. Here the isotropic materials had values of $\in_r$=10 and $\mu_r$=1, as well as $\in_r$=1 and $\mu_r$=10, for the antenna of FIG. 3 and the dimensions listed in Table 2. The plots in FIGS. 4(*a*) and 4(*b*) show relative stability of the realized gain and |S11| curves. These indicate that the model has suppressed the high-order resonances that caused the instabilities at the higher end of the frequency band seen in FIGS. 2(*a*) and 2(*b*).

For the dielectric material, esp. for frequencies from about 290 MHz-500 MHz there is a positive realized gain even though the S11 is not particularly good over the entire range. This stems from the fact that there is a large aperture which becomes larger in terms of wavelength as frequency increases. At around 350 MHz, where $d=\lambda'_r/4$, there is a narrowband match of better than −40 dB corresponding to the peak realized gain of about 5.8 dB. This is expected since the best performance occurs for a rectangular cavity when the back short is located approximately $\lambda'_r/4$ from the aperture at the center frequency.

For the magnetic material, the realized gain starts out positive from 200 MHz and crosses 0 dB at the same point that the realized gain for the dielectric material becomes positive at 290 MHz. The realized gain becomes positive again at about 275 MHz. While both curves have a dip at 420 MHz, the dip of the magnetic material is much more pronounced and it also finishes much lower at the end of the frequency band. The S11 of the magnetic material shows extremely poor S11 over much of the band from 200 MHz-500 MHz. Since the dielectric material and magnetic material seem to cover different parts of the spectrum in terms of positive realized gain, it is of particular interest to see how a magneto-dielectric material performs.

Figure 5A:
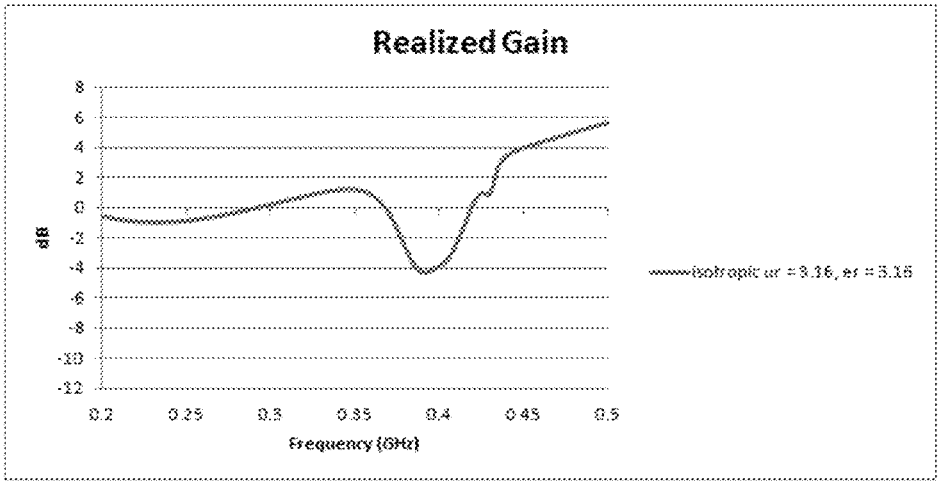
FIG. 5 shows simulation results for the antenna in FIG. 3 loaded with magneto-dielectric isotropic material, where FIGS. 5(*a*) and 5(*a*) show plots of a) realized gain and b) |S11|, respectively.
Figure 5B:
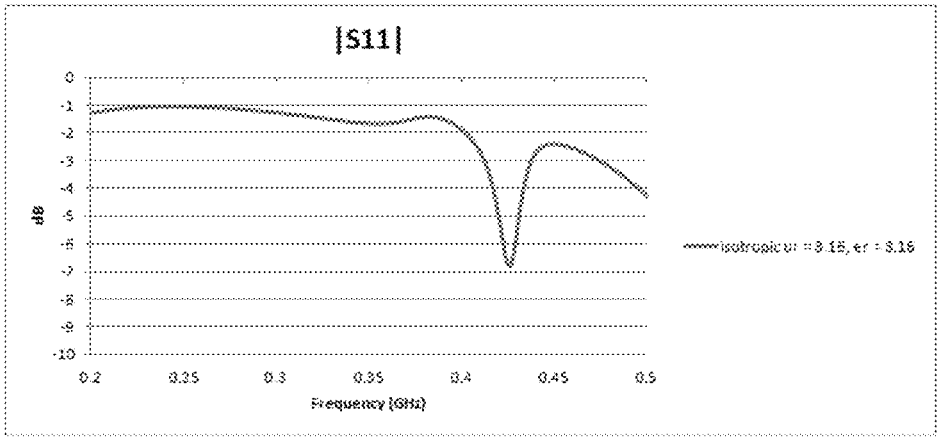

FIG. 5 shows simulation results for the antenna in FIG. 3 loaded with magneto-dielectric isotropic material for material 16, where FIGS. 5(*a*) and 5(*b*) show plots of a) realized gain and b) |S11|, respectively. The isotropic magneto-dielectric material had values of $\in_r=\sqrt{10}$ and $\mu_r=\sqrt{10}$, respectively. These values were chosen so that all antenna dimensions match those in Table 2.

The plot in FIG. 5(*a*) shows a realized gain pattern that has negative realized gain over much of the band from 200 MHz-420 MHz. This seems to indicate that using magneto-dielectric materials is not as effective as a purely magnetic or dielectric isotropic material.

The inventors developed a tapered cavity design based on a transverse resonance technique. By assuming a linear variation in the width of the material, w(z), as shown in FIG. 3, then $L_g(z)$ can be calculated as the unknown distance between the edge of the high index medium and the cavity wall based on a transverse resonance condition in the $x_o$-direction. The dimension a(z) will also change with w(z), and the shape of the taper in a(z) is also determined by the transverse resonance.

Figure 6:
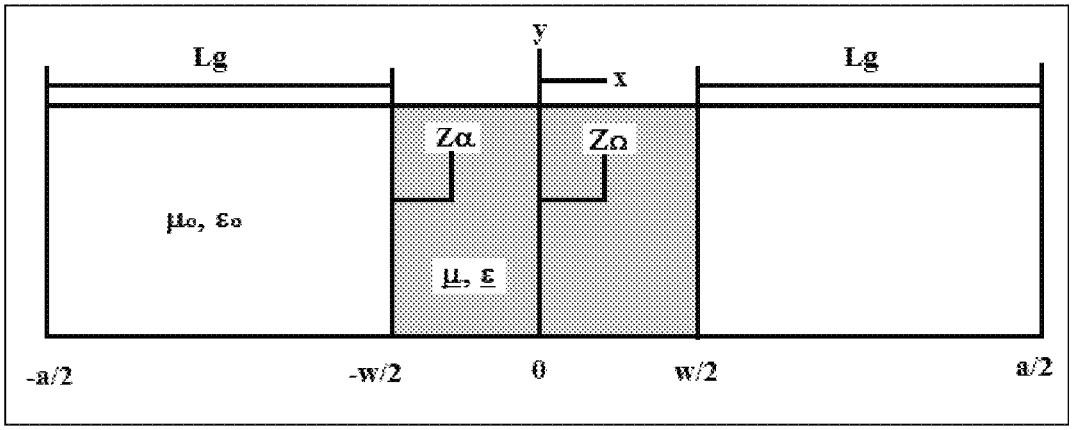
FIG. 6 illustrates the transmission line model of the rectangular antenna cavity.

FIG. 6 illustrates the transmission line model of the rectangular antenna cavity for $L_g$ vs. w. An impedance transformation establishes a symmetric transverse resonance condition at x=0.

Assuming a $TE_{10}$ like resonance at $f_r$, the following assumptions about the field in both regions can be made: $E_z$=0 V/m, $k_z$=0 $m^{-1}$, and $k_y$=0 $m^{-1}$. Here $E_z$ is the electric field in the z-direction while $k_z$ and $k_y$ are the propagation constants in the $z_o$- or $y_o$-directions respectively. With no variation in the $y_o$- or $z_o$-direction, the problem simplifies to the transmission line problem depicted in FIG. 6. The wave equation in the two regions becomes:

$$(d^2/dx^2 + k_o^2)H_{z0} = 0, \quad \begin{cases} -a/2 \le x \le -w/2 \\ w/2 \le x \le a/2 \end{cases} \tag{3a}$$

$$(d^2/dx^2 + k_o^2\varepsilon_r\mu_r)H_{z1} = 0, \quad -w/2 \le x \le w/2 \tag{3b}$$

where $H_{z0}$ and $H_{z1}$ are the $z_o$-component of the magnetic field in the two regions respectively. Using transmission line theory, we can transform the input impedance from the short at x=−a(z)/2 to x=−w(z)/2

$$Z_{in}^{\alpha}(x=-w/2)=jZ_o\tan(\beta_1 L_g), \tag{4}$$

where $z_o=\sqrt{\mu_o/\in_o}$ is the impedance in region 0 and $\beta_o=k_o$ comes directly from equation 3a. Performing the same transformation from x=−w(z)/2 to x=0 yields $$Z_{in}^{\Omega}(x=0) = Z_1\frac{Z_{in}^{\alpha} + jZ_1\tan[\beta_1(w/2)]}{Z_1 + jZ_{in}^{\alpha}\tan[\beta_1(w/2)]}, \tag{5}$$

where $z_1=\sqrt{\mu_r/\in_r}$ is the impedance in region 1 and $\beta_1=k_o\sqrt{\in_r\mu_r}$ comes directly from equation 3b.

By the symmetry that exists around x=0, the transverse resonance condition becomes $2Z_{in}^{\Omega}=0$ or $2Y_{in}^{\Omega}=0$ where $Y_{in}^{\Omega}$ is the input admittance at x=0. At this point, the $L_g(z)$ that satisfies the transverse resonance condition is solved by setting the denominator of equation 5 to zero $$\frac{L_g(z)}{\lambda_o} = \frac{1}{2\pi}\tan^{-1}\left[\frac{\sqrt{\mu_r/\varepsilon_r}}{\tan\left(\pi\sqrt{\mu_r\varepsilon_r}\,w/\lambda_o\right)}\right]. \tag{6}$$

Equation 6 is the unique equation that gives us the shape of a cavity which will ensure the suppression of high order resonances within the cavity over an octave of bandwidth. Equation 6 may be characterized as a tangential equation. At any point on the resonant line, FIG. 6, the sum of the input impedances seen looking to either side must be zero. That is, $Z_{in}^{r}(x)+Z_{in}^{l}(x)=0$, where $Z_{in}^{r}(x)$ and $Z_{in}^{l}(x)$ are the input impedances seen looking to the right and left, respectively, at point x on the resonant line.

The tapering of the cavity walls of the antenna embodiments of the present invention may be based solely on equation 6. Equation 6 is based on the width of the high index medium material at each point in the cavity.

In addition, tapering the high index medium material (when provided) is important as the tapering of the cavity. This is because the shape of the material in the cavity and the shape of the cavity are determined by equation 6. Thus, if one drastically changes so does the other. The inventors chose the triangular prism because it was the easiest shape to model and yielded a relatively simply cavity design. It is the two shapes in tandem that yields the improved wideband VSWR shown in FIG. 15(*b*) and FIG. 16(*b*).

Figure 7:
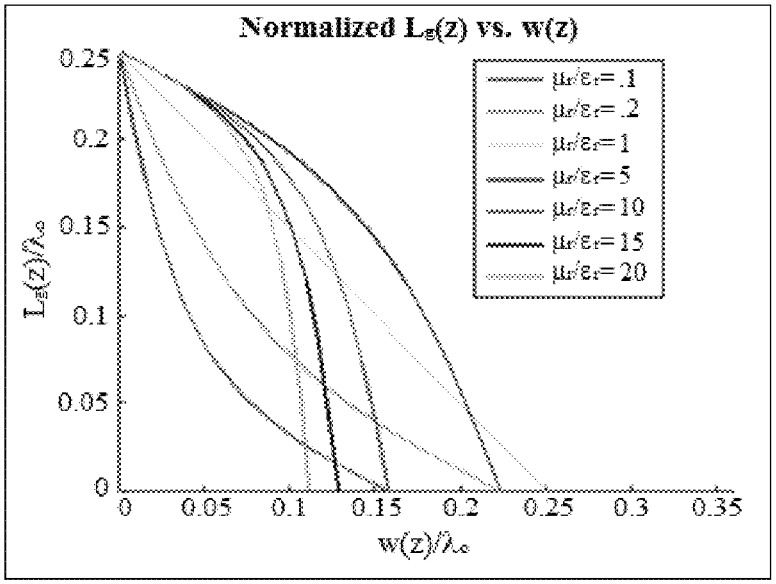
FIG. 7 depicts plots of the normalized relationship of parameters (i.e., $L_g/\lambda_o$ versus $w/\lambda_o$ curves for different ratios of $\mu_r/\in_r$) of Equation 6.

FIG. 7 depicts plots of the normalized relationship of $L_g/\lambda_o$ versus $w/\lambda_o$ curves for different ratios of $\mu_r/\in_r$ for equation 6. Looking at these plots, it is quite apparent that the cavity taper has an inverse-like relationship for when the ratio is positive versus when the ratio is negative. This stems directly from the numerator of equation 6. From these plots, it should be appreciated that the cavity may have a linear tapering, concave tapering or convex tapering according to various embodiments of the present invention.

The linear tapering is just a specialized case of equation 6. For instance, if ∈r=μr≠1 then the antenna would have a linear taper. This is depicted as the μr/Σr=1 curve of FIG. 7. The linear taper would look similar to the antenna design shown in FIG. 3. However, it is important to point out that the antenna design of FIG. 3 was not specifically designed according to equation 6. It was simply an approximation that we used as part of the investigation process. If both μr=1 and ∈r=1, then there will be no taper because this represents a rectangular cavity filled with air and no high index medium exists. This condition is what is shown in FIG. 1.

The convex and concave tapers will now be explained. FIGS. 8 and 9 show tapered rectangular cavity antenna configurations based on equation 6 when $\mu_r/\in_r<1$ and $\mu_r/\in_r>1$, respectively.

More particularly, FIG. 8 is an illustration of an antenna 200 having a convex tapered cavity partially 51 loaded with isotropic high index medium material 16, where FIG. 8(*a*) shows a top plan view, FIG. 8(*b*) shows a side view, FIG. 8(*c*) shows an isometric view of the antenna.

The convex tapered antenna cavity 51 is formed of a pair of spaced-apart longitudinal (long) sidewalls 27, a pair of spaced-apart laterally-tapered (short) sidewalls 32, and the flat bottom wall 37. The cavity 50 has an overall length $a_0$ and width b with the flat bottom wall 37 having a length $a_1$ and the tapered sidewalls 32 tapering in such a way as to maintain a nearly constant $f_r$. The width b is constant. As apparent, the tapered sidewalls 32 have a convex taper extending away from the flat bottom wall 37 portion in opposite directions toward the aperture 10. The tapered sidewalls 32 are symmetrically shaped. Here, the convex tapered cavity 51 has the parameter values listed in Table 3 for a case where the ratio of the ratio of $\mu_r/\in_r$ is 0.1.

FIG. 9 is an illustration of an antenna 300 having a concave tapered cavity 52 partially loaded with isotropic high index medium material 16, where FIG. 9(*a*) shows a top plan view, FIG. 9(*b*) shows a side view, FIG. 9(*c*) shows an isometric view of the antenna.

The convex tapered antenna cavity 52 is formed of a pair of spaced-apart longitudinal (long) sidewalls 28, a pair of spaced-apart laterally-tapered (short) sidewalls 33, and the flat bottom wall 38. The cavity 52 has an overall length $a_0$ and width b with the flat bottom wall 38 having a length $a_1$ and the tapered sidewalls 33 tapering in such a way as to maintain a nearly constant $f_r$. The width b is constant. As apparent, the tapered sidewalls 33 have a concave taper extending away from the flat bottom wall 38 portion in opposite directions toward the aperture 10. The tapered sidewalls 33 are symmetrically shaped. Here, the concave tapered cavity 52 has the parameter values listed in Table 3 for a case where the ratio of the ratio of $\mu_r/\in_r$ is 10.

TABLE 3

| $a_0$ | b | $a_1$ | $f_r$ | d | δ | PW | L |
|---|---|---|---|---|---|---|---|
| 29.5 | 13.1 | 9.3 | 200 MHz | 4.2 | 0.27 | 0.7 | 8.5 |

It is noted that both of the configuration in FIGS. 8 and 9 may include a 1.0 inch metallic flange that is not shown. This flange serves the same purpose as it did for the antenna shown in FIG. 3. The severity of the taper in both cases will vary with the magnitude of the ratio. The rectangular probe is located at z=−δ+0.08". The cavity's taper is a direct result of equation 6.

For the antenna designs in FIGS. 8, 9, 11 and 12, the amount of high-index medium material used is about 6,947 $cm^3$ or $V=0.5*a_1*d*b$. This is significantly less high-index medium material than used in the rectangular cavity design depicted in FIG. 1. The tapered cavities of FIGS. 8, 9, 11, and 12 are a result of the derivations by the inventors to maintain a constant resonance frequency within the cavity. By contrast, the rectangular radiating cavity of the antenna in FIG. 1 cannot maintain a constant resonance frequency.

Figure 10A:
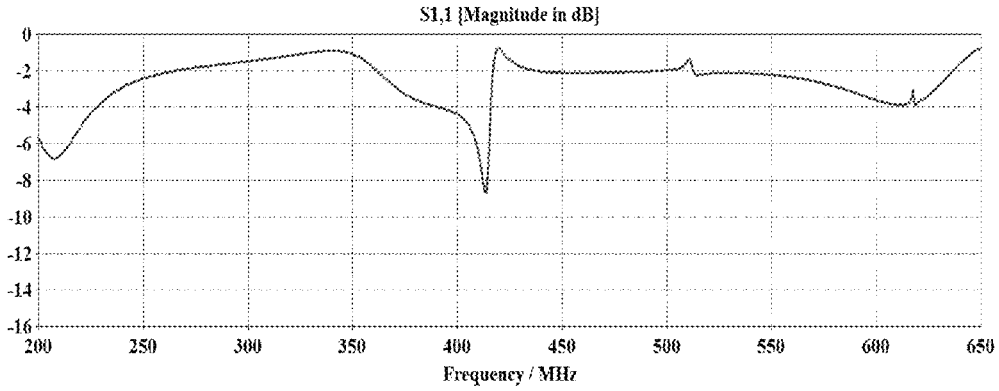
FIG. 10 shows initial simulation results for the antenna model depicted in FIG. 9 when $\mu_r$=10 and $\in_r$=1, where FIG. 10(*a*) shows |S11|, FIG. 10(*b*) shows VSWR, and FIG. 10(*c*) shows realized gain, respectively, for the antenna.
Figure 10B:
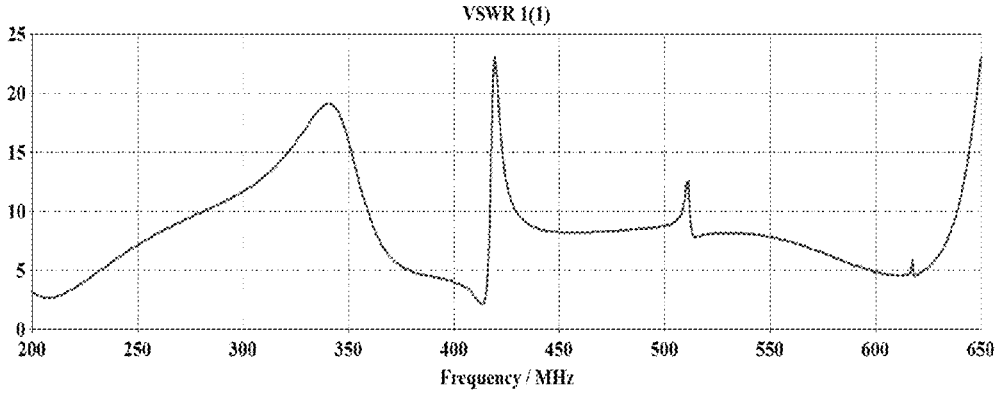
Figure 10C:
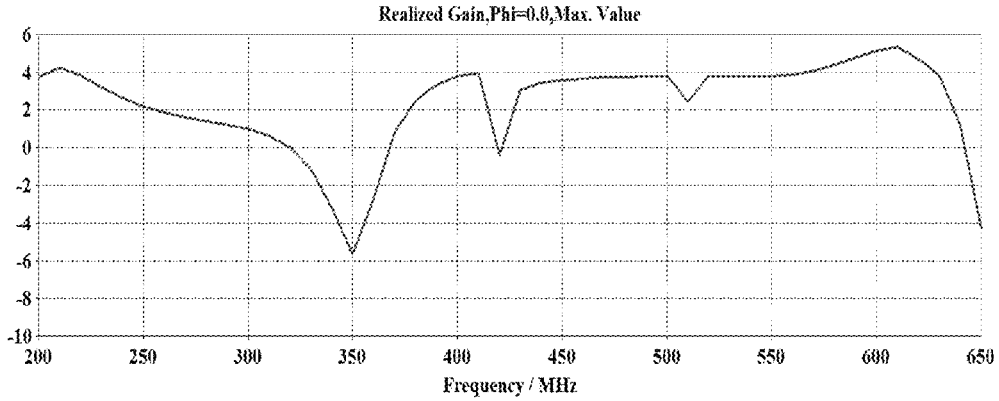

FIG. 10 shows initial simulation results for the antenna model depicted in FIG. 9 when $\mu_r=10$ and $\in_r=1$, where FIG. 10(*a*) shows |S11|, FIG. 10(*b*) shows VSWR, and FIG. 10(*c*) shows realized gain, respectively, for the antenna. These are the first recorded data from the simulations ran on the above models. These results, though, are preliminary and not very good.

The inventors desired to improve the |S11| and VSWR between 200-300 MHz. Up until this point, all iterations and embodiments of the invention have used a one-port input feed connected to a single rectangular probe port 20. However, using a two-port input feed connected to two symmetric rectangular probe ports 21 may serve to improve our input impedance match. By feeding the two ports 21 180° out of phase, the dual probe feed structure provides a continuous current path from one input to the other. This manifests itself as a +/− voltage drop across the two input ports as indicated in FIGS. 11 and 12. This is accomplished via the phase difference because $e^{j*0}=+1$ and $e^{j*\pi}=-1$.

FIGS. 11 and 12 show tapered cavity antennas based on equation 6 when $\mu_r/\in_r=0.098$, and $\mu_r/\in_r=15$, respectively. The two-input feed port 21 is apparent in these figures (whereas FIGS. 3, 8 and 9 only showed a single input feed). The antennas illustrated in FIGS. 11 and 12 are similar to those in FIGS. 8 and 9, other than that they use a two-input feed port 21 and have different design parameters as set forth in the corresponding Tables. Thus, alike elements are not further described.

FIG. 11 is an illustration of a low profile convex tapered cavity antenna 400 based on the isotropic resonance condition and using the dual symmetric rectangular probe 21, where FIG. 11(*a*) shows a top plan view, FIG. 11(*b*) shows a side view, FIG. 11(*c*) shows an isometric view of the antenna. Here, the convex tapered cavity 51 has the parameter values listed in Table 4 for a case where the ratio of the ratio of $\mu_r/\in_r$ is equal to 0.098.

FIG. 12 is an illustration of a concave tapered cavity 500 based on the isotropic resonance condition and using the dual symmetric rectangular probe 21, where FIG. 12(*a*) shows a top plan view, FIG. 12(*b*) shows a side view, FIG. 12(*c*) shows an isometric view of the antenna. Here, the concave tapered cavity 52 has the parameter values listed in Table 4 for a case where the ratio of the ratio of $\mu_r/\in_r$ is equal to 15.

Table 4 lists the dimensions for simulations of the isotropic cavity model in antenna in FIGS. 11 and 12. The antenna in FIG. 11 has been optimized for ROGERS 6010 material. This material is an inexpensive commercial-off-the-shelf (COTS) dielectric material with $\mu_r/\in_r=1/10.2$ and a loss tangent of tan δ=0.0023. FIG. 12 represents an antenna that has been optimized for a lossless magnetic material with $\mu_r/\in_r=15$.

TABLE 4

| $a_0$ | b | $a_1$ | $f_r$ | d | Δ | PW | L |
|---|---|---|---|---|---|---|---|
| 39.4" | 17.5" | 10.2" | 150 (MHz) | 4.2" | 0.27" | 0.25b | $0.35a_0$ |

Figure 13A:
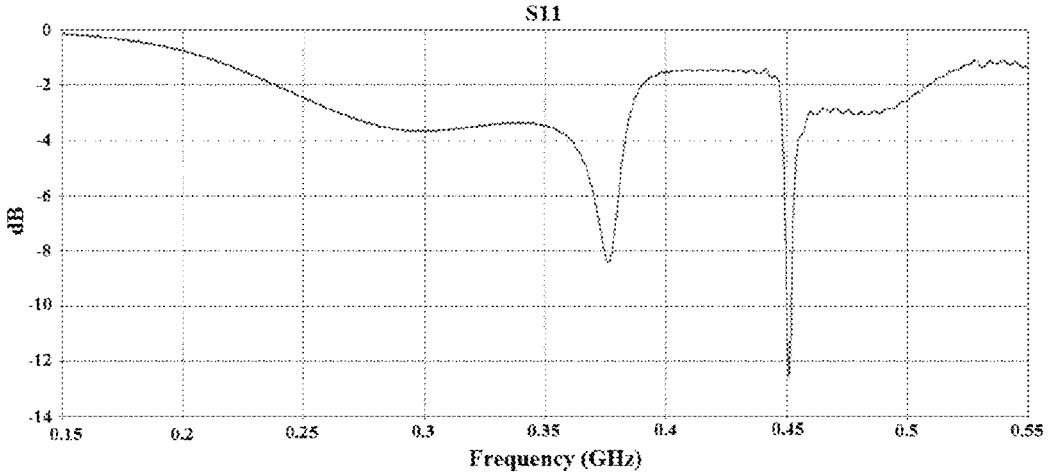
FIG. 13 shows simulation results for the antenna configuration depicted in FIG. 11, where FIG. 13(*a*) shows |S11|, FIG. 13(*b*) shows VSWR, and FIG. 13(*c*) shows realized gain, respectively, for the antenna.
Figure 13B:
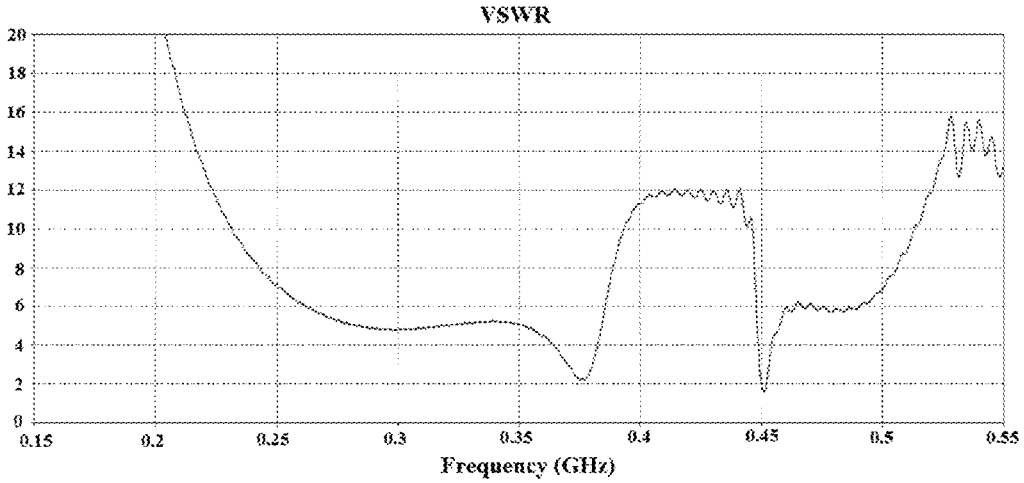
Figure 13C:
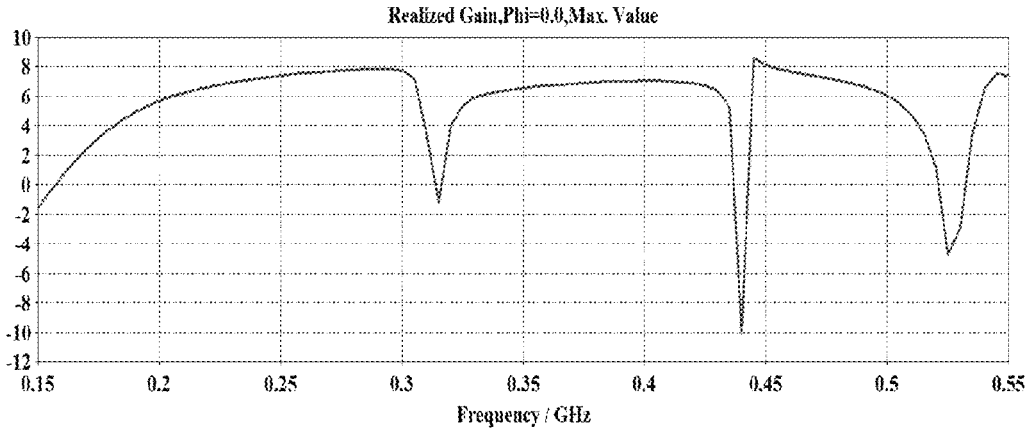

FIG. 13 shows simulation results for the antenna configuration depicted in FIG. 11 with the Rogers6010 material, where FIG. 13(*a*) shows |S11|, FIG. 13(*b*) shows VSWR, and FIG. 13(*c*) shows realized gain, respectively, for the antenna. These results show a narrowband |S11|<−6 dB and VSWR <3:1 at about 375 MHz. The desired broadband performance is not apparent for the antenna design in FIG. 10(*a*) using a cheap dielectric material.

The antennas in FIGS. 11 and 12 were feed with a symmetric dual rectangular probe of thickness T=2 mm. The two probes were shorted to the inner conductors of two separate 50Ω coaxial lines. This results in driving the two input ports with two separate waveguide ports that are 180° out of phase with an equal magnitude. This is an optimized way to drive the antenna, but in reality one would want a feed structure with a single input port and two output ports with −3.0 dB insertion loss (this is a lossless one-half power split) as well as a 180° phase shift.

Figure 14A:
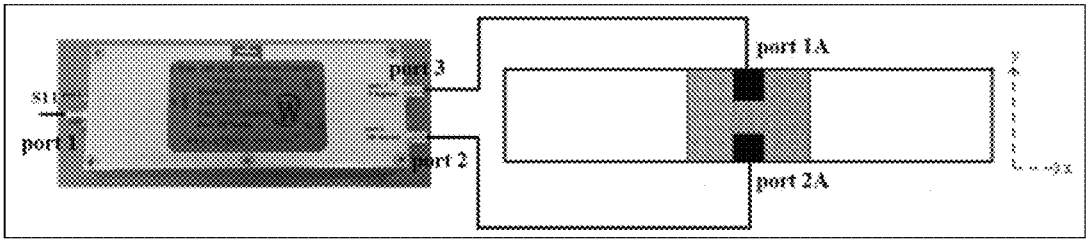
FIG. 14(*a*) shows the connectivity between the 180° coupler and the two-port antenna.
Figure 14B:
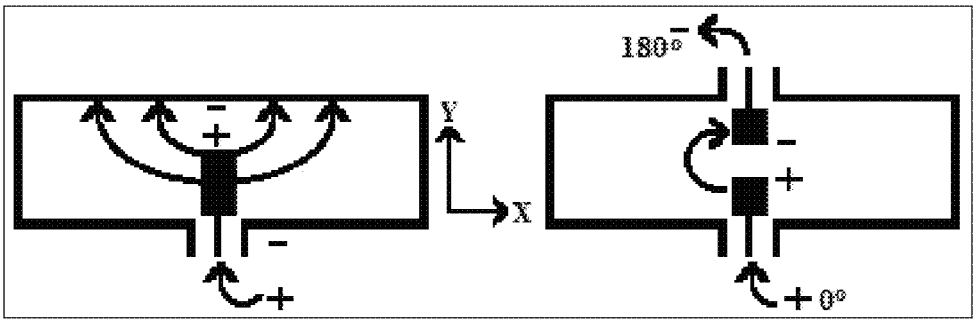

FIG. 14(*a*) shows the connectivity between the 180° coupler and the two-port antenna. Any commercial splitter or self-designed splitter could be used, but the symmetric probe dimensions have been optimized taking this external device into account. The one used by the inventors was a Werlatone 2-Way 180° Combiner/Divider model #: H7971-102, for example. The output ports 2 and 3 of the coupler connect to the antenna input ports 1A and 2A. All antenna dimensions are consistent with Table 4. Substituting a different commercial device may require additional probe tuning. It is important to show that the antenna has been designed to connect to any 50 ohm device without degrading performance. This is very important for any commercial applications.

FIG. 14(*b*) shows the advantage of an symmetric over an asymmetric feed. A single asymmetric probe produces fringing fields over the potential difference between the probe and cavity walls (shown in the left figure). These fringing fields cause a reactance that produces a mismatch between the coaxial line and the impedance seen at the cavity aperture. This feed causes this potential difference as a result of the 180° phase shift between the inner and outer conductors of the coaxial line.

To reduce this mismatch, the inventors used a balanced feed structure which provides a continuous current path of a symmetric dual probe feed. This is shown in the right figure By feeding the two symmetric probes 180° out of phase, there is now a potential difference between the two probes providing a continuous path for the current.

Figure 15A:
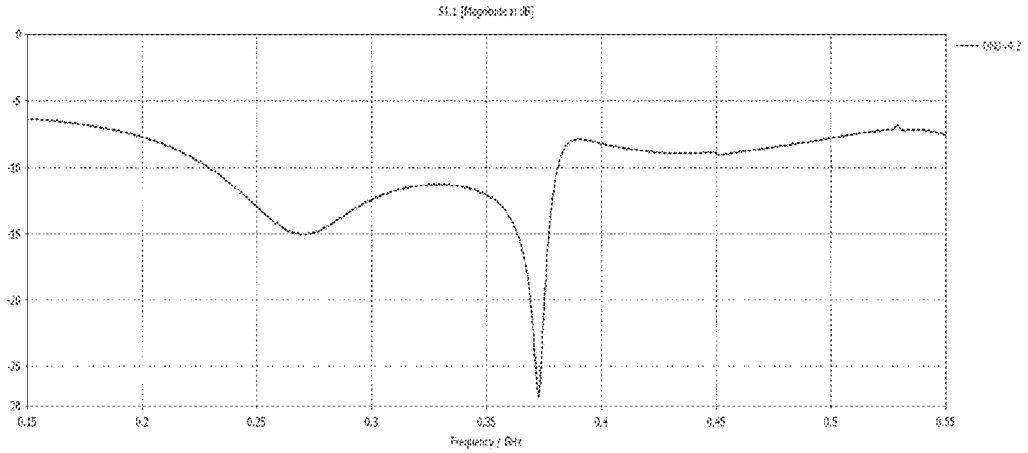
FIG. 15 show the performance of the antenna shown in FIG. 11, where FIG. 15(*a*) shows |S11|, FIG. 15(*b*) shows VSWR, and FIG. 15(*c*) shows realized gain, respectively, for the antenna.
Figure 15B:
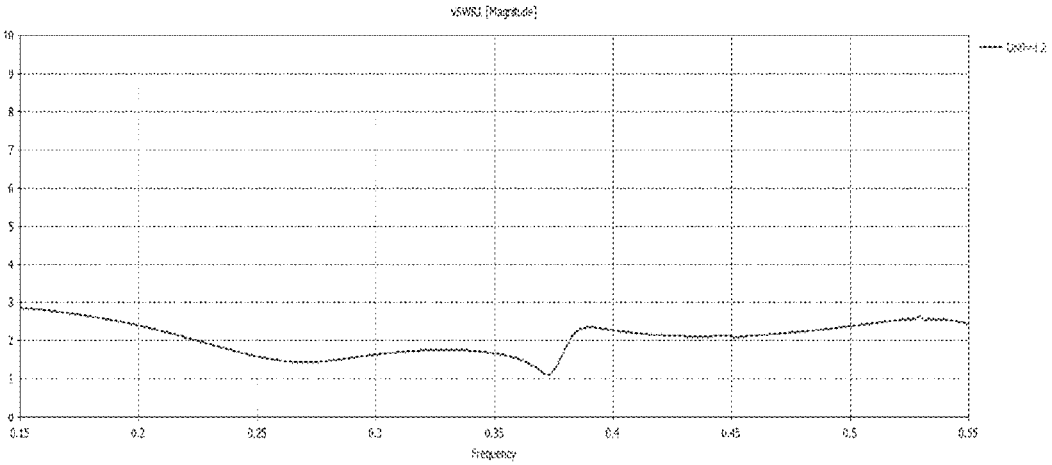
Figure 15C:
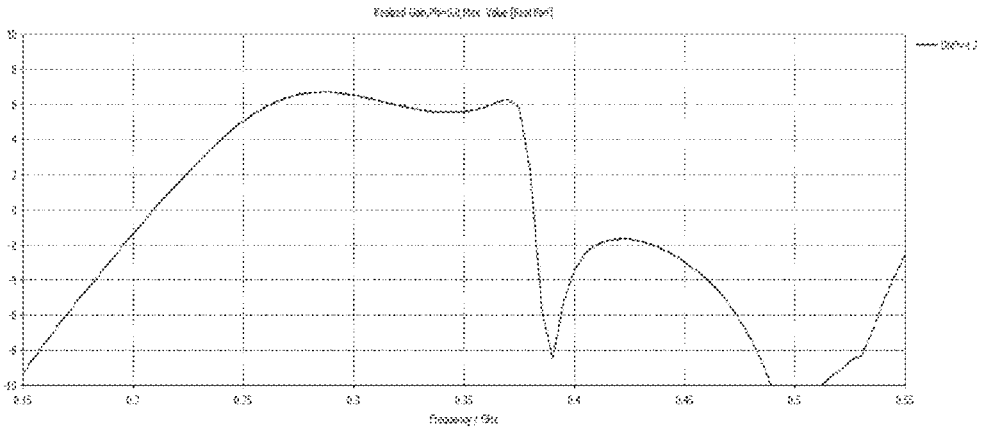

FIG. 15 show the performance of the antenna shown in FIG. 11 cascaded in series with the Werlatone 2-Way 180° Combiner/Divider model #: H7971-102, where FIG. 15(*a*) shows |S11|, FIG. 15(*b*) shows VSWR, and FIG. 15(*c*) shows realized gain, respectively, for the antenna. and parameter values listed in Table 4 using ROGERS 6010 dielectric material. These plots show S11<−6 dB and VSWR <3:1 from 150-550 MHz and a positive realized gain from 210-380 MHz.

These results demonstrate more than two octaves of 3:1 VSWR are achieved, however, the positive realized gain is only positive over a 81% bandwidth. This has been accomplished both by a broadening and flattening of the |S11| curve by implementing the symmetric probe as well as by shifting the entire curve down in frequency by changing $f_r$ to 150 MHz from 200 MHz. This change in $f_r$ has altered the values of $a_0$, b, $a_1$, PW, and L but has not changed the cavity depth.

An 81% bandwidth is still a significant accomplishment at these frequencies, and not all applications will require a positive realized gain which is why bandwidth is generally defined in terms of the input impedance match. Note that the positive realized gain corresponds to the same bandwidth where S11<−10 dB and VSWR <2:1.

Figure 16A:
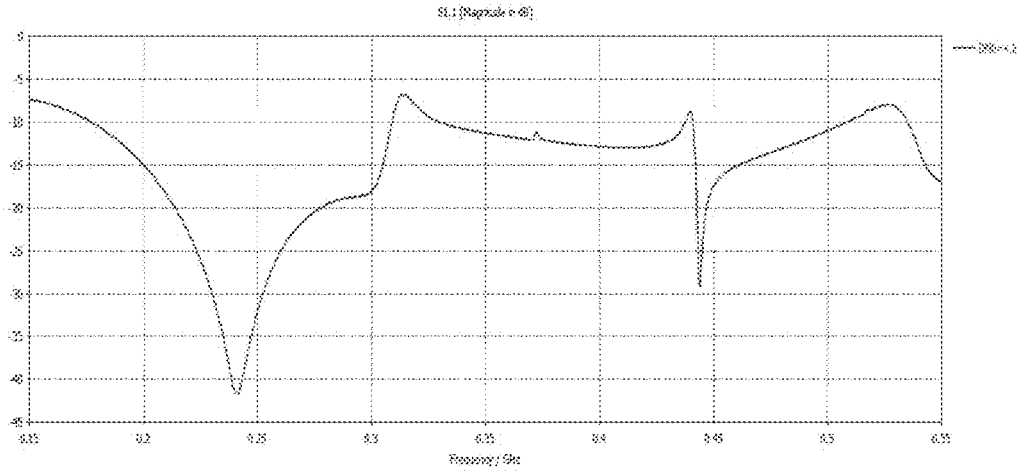
FIG. 16 show the results for the antenna shown in FIG. 12, where FIG. 16(*a*) shows S11, FIG. 16(*b*) shows VSWR, and FIG. 16(*c*) shows realized gain for the antenna.
Figure 16B:
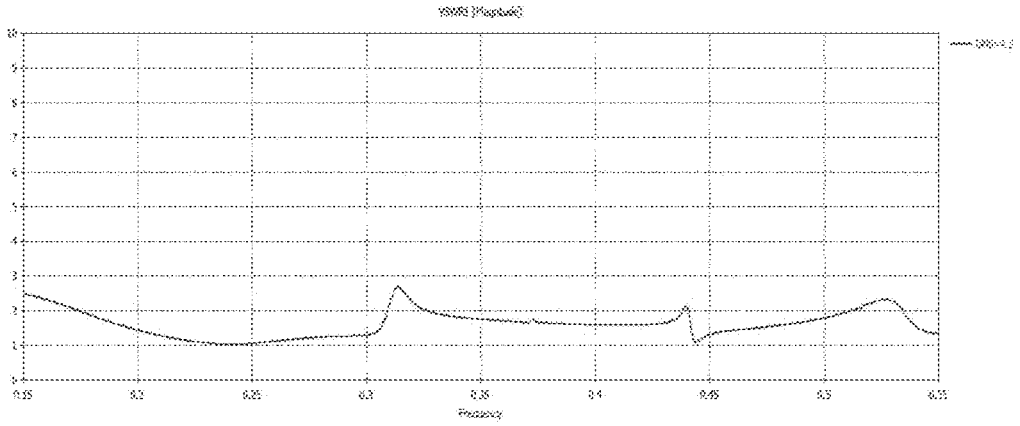
Figure 16C:
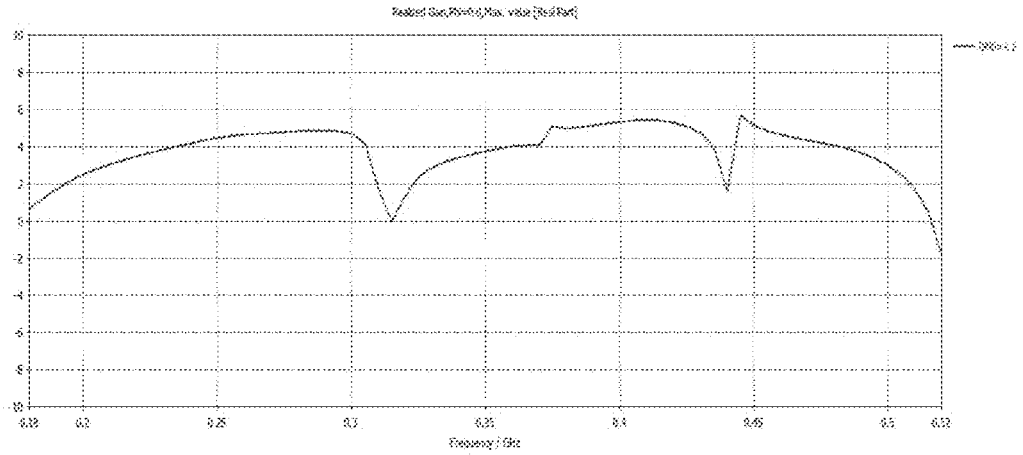

FIG. 16 show the results for the antenna model depicted in FIG. 12, with material exhibiting $\mu_r/\in_r$=15:1, cascaded with the Werlatone 2-Way 180° Combiner/Divider model #: H7971-102, where FIG. 16(*a*) shows S11, FIG. 16(*b*) shows VSWR, and FIG. 16(*c*) shows realized gain for the antenna and parameter values listed in Table 4 for material with $\mu_r/\in_r$=15. The plots show S11<−6 dB and VSWR <3:1 from 150-550 MHz and a positive realized gain from 150-515 MHz.

More than 2 octaves of bandwidth with positive realized gain are now achieved over the entire band. While this is a large improvement over the gain performance of the dielectric antenna, low loss magnetic materials at these frequencies have to be engineered metamaterials which could potentially make the antenna in FIG. 12 less cost effective than that of FIG. 11.

The probe dimension PW and L directly affect the performance of the VSWR curve, and the values in Table 4 are optimized for broadest 3:1 VSWR bandwidth. Further improvement in the VSWR is possible at the sacrifice of bandwidth. Similarly, there is the potential to shift the frequency either up or down by changing the dimensions of $a_0$ and $a_1$. The parameters b, PW, and L would be scaled by the same factor. It is also important to note that further reduction in profile always comes at the expense of a degraded input impedance match.

If the total size of the planar aperture is too large, one could reduce the size of the b parameter. This would reduce the realized gain, but would still maintain the same operational frequency established by a(z). Also, the probe dimension L would have to be scaled by the same factor.

The combination of realized gain and return loss yields an 81% bandwidth for a dielectric antenna design depicted in FIG. 10*a* utilizing off-the shelf material. Similarly, almost a 250% −6 dB bandwidth is seen for the antenna design shown in FIG. 10*b*.

Adding a 180° hybrid coupler has improved the return loss at the input to the system and increased the bandwidth. Based on the 3:1 VSWR bandwidth with a commercial coupler attached this yields a $\lambda_o/19$ profile at 150 MHz. The fact that the antenna has approximately 2.5 octaves in bandwidth based on a S11<−6 dB, while achieving a constant $f_r$ while loaded with a high index medium, makes it significant improvement in the art achieving previously unseen properties in terms of multi-mode resonances within the cavity.

Various low-profile, tapered cavity broadband antennas, according to embodiments of the present inventions, have been shown to be able to achieve nearly a 250% −6 dB bandwidth. Some exemplary embodiments may be suitable for use UHF applications, i.e., radio frequencies in the range between 300 MHz and 3 GHz. Although, other exemplary operating bands are certainly possible in accordance with this disclosure. It is also important to note achieving a low profile at low UHF frequencies may be more difficult than at higher frequencies in some instances. This is because as the frequency increases the free space wavelength decreases very rapidly.

At higher frequencies (e.g., above 1.0-1.5 GHz), a designer could more easily create a low profile λ/4 cavity backed antenna without the need for high index medium material. For example $\lambda_o/4$=1.5 inches at 2 GHz. Therefore, one could achieve a low profile, antenna with an air-filled tapered cavity.

Generally, any metallic or conductive material, such as aluminum, copper, steel or iron, etc. may be used to form the cavity in various embodiments. Different metals should not change the performance of the antenna; rather, they would only change the structural integrity and/or weight of the antenna. The primary material that governs the antenna's performance is the high index medium that is placed inside the cavity. A machine shop should be able to create a tapered cavity without needing any type of specialized equipment. For instance, five metal sides can joined together at angles. For the shape of the tapered medium, triangular blocks could be stacked together. For traditional isotropic materials, they could be cut to length/size without affecting the material properties.

The various antennas embodiments may be used for various applications. For example, they may be used to covert ground point-to-point communications, provide airborne-to ground communications or airborne fixed-wing radar applications platforms where a thin profile reduces air resistance and drag, and enable mobile communication application in urban areas or other areas where overhead clearance is an issue. Additionally, they may provide improvement to broadband radar applications whether ground based or air based.

Aspects related to this innovative technology have been previously disclosed by: (i) Gregory Mitchell & Wasyl Wasylkiwskyj, in a conference presentation at the URSI National Radio Science meeting in Boulder, Colo. on Jan. 9, 2014; and (ii) Gregory A. Mitchell, in a technical report published by the U.S. Army Research Laboratory titled "Comparison of Anisotropic versus Isotropic Metamaterials in Low Profile UHF Antenna Design", ARL-TR-7012, August 2014. These disclosures are incorporated herein by reference in their entireties.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the present disclosure and its practical applications, to thereby enable others skilled in the art to best utilize the invention and various embodiments with various modifications as may be suited to the particular use contemplated.

While the foregoing is directed to embodiments of the present invention, other and further embodiments of the invention may be devised without departing from the basic scope thereof, and the scope thereof is determined by the claims that follow.

The invention claimed is:

1. A low profile, tapered cavity antenna comprising:

an aperture defining an opening to a cavity; and an interior space defined by the cavity which is formed of a flat bottom wall defining a ground plane, and a pair of spaced-apart, tapered lateral sidewalls extending away from the flat bottom wall in opposite directions toward the aperture, wherein the tapered shape of the tapered lateral sidewalls are configured to maintain a constant resonance frequency within the cavity.

2. The antenna of claim 1, further comprising an isotropic high index medium material at least partially loaded within the cavity, wherein it is the combination of the tapered shape of the tapered lateral sidewalls and the shape of the isotropic high index medium material which maintains a constant resonance frequency within the cavity.

3. The antenna of claim 2, wherein the isotropic high index medium material comprises a magneto-dielectric material with a magnetic property dominance having a permittivity Er less than its permeability $\mu_r$.

4. The antenna of claim 2, wherein the isotropic high index medium material comprises a magneto-dielectric material with a dielectric property dominance having a permittivity Er greater than its permeability $\mu_r$.

5. The antenna of claim 2, wherein the isotropic high index medium material is provided on the flat bottom wall.

6. The antenna of claim 5, wherein the isotropic high index medium material is tapered with an inverse relationship to that of the width of the tapered lateral sidewalls.

7. The antenna of claim 1, wherein the cavity is air-filled, and it is the tapered shape of the lateral sidewalls, by itself, that maintains the constant resonance frequency within the cavity.

8. The antenna of claim 1, further comprising a pair of spaced-apart, longitudinal side portions extending from opposing sides of the flat bottom wall opposite from where the tapered lateral sidewalls extend in substantially perpendicularly direction to the aperture.

9. The antenna of claim 2, wherein the tapered shape of the tapered lateral side portions is defined by a tangential equation based on both a relative permittivity ($\in_r$) and a relative permeability ($\mu_r$) of the isotropic high index medium material.

10. The antenna of claim 9, wherein the tangential equation is defined as follows:

$$\frac{L_g(z)}{\lambda_o} = \frac{1}{2\pi}\tan^{-1}\left[\frac{\sqrt{\mu_r/\varepsilon_r}}{\tan\left(\pi\sqrt{\mu_r\varepsilon_r}\,w/\lambda_o\right)}\right],$$

where $L_g$ is the length of the cavity, w is the width of the cavity, $\lambda_0$ is an anticipated wavelength, $\in_r$ is the relative permittivity of the isotropic high index medium material, and $\mu_r$ is the relative permeability of the isotropic high index medium material.

11. The antenna of claim 9, wherein the tapered shape is linear.

12. The antenna of claim 9, wherein the tapered shape is convex.

13. The antenna of claim 9, wherein the tapered shape is concave.

14. The antenna of claim 1, wherein the antenna is fed with a single input port.

15. The antenna of claim 1, wherein the antenna is fed with two input ports.

16. The antenna of claim 15, wherein the two input ports are symmetrically feed.

17. The antenna of claim 1, further comprising a flange surrounding the aperture.

18. The antenna of claim 1, wherein the cavity is formed of a metallic or conductive material.

19. The antenna of claim 1, wherein the antenna is configured to provide at least 2 octaves of −6 dB bandwidth with a positive realized gain from about 150-515 MHz.

20. A low-profile, tapered cavity antenna comprising:

a rectangular aperture defining an opening to a cavity; and an interior space defined by the cavity which is formed of:

a flat bottom wall defining a ground plane, a pair of spaced-apart, longitudinal sidewalls extending from opposing sides of the flat bottom wall substantially perpendicular to the aperture, and a pair of spaced-apart, tapered lateral sidewalls being symmetric and extending toward the aperture from opposing sides of the flat bottom wall on opposite sides from where the longitudinal sidewalls extend, wherein the antenna is configured to maintain a constant resonance frequency within the cavity.

* * * * *